United States Patent [19]

Gillum

[11] 4,450,750

[45] May 29, 1984

[54] DUAL SHELL FEEDING APPARATUS, WITH SHELL ACCUMULATORS, FOR AUTOMATIC GUNS

[75] Inventor: Richard R. Gillum, Marblehead, Ohio

[73] Assignee: Ares, Inc., Port Clinton, Ohio

[21] Appl. No.: 313,221

[22] Filed: Oct. 20, 1981

[51] Int. Cl.[3] ..... F41D 10/32

[52] U.S. Cl. ..... 89/33 SF

[58] Field of Search ..... 89/33 SF, 33 BA, 33 BC, 89/33 CA, 33 E, 33 B, 33 D

[56] References Cited

U.S. PATENT DOCUMENTS

| | | | |
|---|---|---|---|
| 3,455,204 | 7/1969 | Stoner | 89/33 SF |
| 3,683,743 | 8/1972 | Stoner | 89/33 SF X |
| 3,875,845 | 4/1975 | Hupp | 89/33 SF |
| 4,069,740 | 1/1978 | Hottinger | 89/33 SF |
| 4,092,900 | 6/1978 | Hottinger | 89/33 B |
| 4,119,012 | 10/1978 | Frye | 89/33 SF |
| 4,127,055 | 11/1978 | Hottinger | 89/33 D |
| 4,223,589 | 9/1980 | Post | 89/33 SF |

*Primary Examiner*—Donald G. Kelly

*Attorney, Agent, or Firm*—Fowler, Lambert & Hackler

[57] ABSTRACT

Dual shell feeding apparatus for a dual shell supply automatic gun and the like includes a shell rotor mounted in rotational shell transferring relationship between the two supplies and a shell pick up position of the gun. The rotor is stepped in one rotational direction to feed from one shell supply and the opposite direction to feed from the other supply, shells being fed into the rotor from the supplies according to rotor rotational direction. Selecting apparatus enables prefiring selection of rotor stepping direction and hence shell supply selection for a next firing. A shell accumulator is provided for temporarily holding shells left in the rotor when a firing sequence stops. In response to the selecting apparatus selecting a different one of the shell supplies for feeding the gun during a next firing sequence, shells left in the rotor from the previously selected supply are transferred to the accumulator while shells previously transferred into the accumulator from the just selected supply are transferred back into the rotor for firing.

19 Claims, 15 Drawing Figures

DUAL SHELL FEEDING APPARATUS, WITH SHELL ACCUMULATORS, FOR AUTOMATIC GUNS

BACKGROUND OF THE INVENTION

1. Field of the Invention

The present invention relates generally to shell feeding apparatus for guns, and more particularly to dual shell feeding apparatus enabling selective feeding of two different types of shells to automatic guns, such as antiaircraft guns.

2. Discussion of the Prior Art

Many large calibre military guns are required to have capability for rapidly switching between different types of shells to be fired, according to the types of combat targets presented. As an illustration, mobile automatic antiaircraft guns, typically in the 30–40 milimeter calibre range, use high explosive (HE) shells against enemy aircraft. However, such guns may sometimes be required to shift their combat role to defense against enemy tanks; and for such role, armor piercing (AP) shells must be used.

In addition, because in actual or simulated combat situations a diversity of target types may pose simultaneous or nearly simultaneous threats, capability for rapid switching between ammunition types is necessary for weapon system effectiveness. Consequently, manual changing of ammunition belts or clips to the gun is, for example, unsatisfactorily slow. Instead, automated dual shell supply selection and feeding is typically specified in procurement RFO's and contracts.

One solution to the problem of providing rapid interchange for automatic cannon between shell types is, as an example, disclosed in the U.S. Pat. No. 3,683,743 to Eugene Stoner. There is disclosed therein a cylindrical ammunition drum divided into a large number of small, pie-shaped segments each capable of holding a row of 10 or 20 (typically) shells which point inwardly towards a drum axis. An electric drive rotates the entire drum segment assembly, with shells, past a feed port communicating with a shell feeder mounted on the associated gun. Before firing, a selected one of the segments is rotated to the feed port, and shells therefrom are advanced through the port and feeder to the gun during firing.

Control means enable gunner selection of which drum segment is rotated to the feed port. Since the drum segments can be loaded with different types of shells, rapid switching between shell types is enabled by this drum segment selection procedure.

Shell supply and feed systems, such as that disclosed are very versitile, particularly since more than two types of shells can readily be provided. Also, the system is relatively simple because only a single, fixed feeder is required, all the shells, regardless of type, being infed from the drum to the feeder through the single feed port.

In spite of the many advantages of such a segmented drum-type shell supply and feeding system, for various reasons it cannot be adapted for all gun systems in which dual shell supplies are required. For example, space and weight limitations for some weapons systems may dictate use of linked or belted ammunition or use of hopper-type shell magazines instead of drum magazines. In some instances, existing weapons systems not configured for the segmented drum magazines must be upgraded or retrofitted for dual shell-type capabilities.

Accordingly, two separate shell feeders may be adjustably mounted on the gun, each feeder being fed shells from a separate shell supply, such as an ammunition belt or magazine. The two shell supplies enable containment of two different types of shells, shell type being selected by positioning the appropriate one of the feeders into shell feeding relationship with the gun. Operationally the two feeders are interconnected so that when either feeder is moved into the feed position, the other feeder is moved away therefrom. Shifting between the feeders, and hence selecting of shell type to be fired, may either be manual or power driven. However, in either case, shell type shifting is relatively rapid.

Shiftable, double feeders of this type are, for example, disclosed in the U.S. Pat. Nos. 3,455,204 and 3,875,845 to Stoner and Hupp, et al, respectively.

A disadvantage of such shiftable, double feeders is that the gun system must be configured to allow several inches of transverse feeder shifting travel, as well as similar movement of at least portions of the shell supplies. Thus, this type of feeding apparatus is best adapted for belted or linked ammunition, the belts being sufficiently compliant to accommodate limited feeder switching movement. Also, because of the feeder shifting required, the guns are subject to malfunction if the feeder shifting mechanism becomes jammed or becomes even partially blocked.

Thus, it is still desirable for many gun systems to provide a single shell feeder which does not require any translational movement to switch between feeding shell-types, but which is adaptable to different ammunition supply configurations. Accordingly, my copending U.S. Pat. application Ser. No. 118,763 now U.S. Pat No. 4,331,081 issued Jan. 19, 1982 discloses a single, fixed shell feeder configured for selectively feeding shells from two different shell supplies. As disclosed, the feeder includes a single shell transferring rotor, of the star wheel type, mounted for selective, bidirectional rotation at a shell pick up or ram position of an associated automatic cannon.

The rotor has an even number of shell transporting cavities which can be rotatably indexed into shell receiving relationship with two independent shell supplies located on opposite sides of the feeder and gun. Even numbered rotor cavities transport shells from one shell supply to the pick up position when the rotor is rotated in one direction and the interspersed, odd numbered shell cavities transport shells from the other supply to the pick up position when the rotor is rotated in the other direction.

Furthermore, the disclosed feeding apparatus is configured such that when firing of either selected type of shells is stopped, some of the corresponding rotor cavities remain "loaded" with that type shells so that firing can subsequently be resumed without recharging the gun. As a consequence, after initial gun charging and whenever firing is stopped, the rotor is loaded with both types of shells and the gun is immediately ready for a next firing of either type of shell, according to whichever shell type is then selected by the gunner. Shell type selection automatically sets rotor shell feeding rotational direction and pre-firing rotates the rotor to index a loaded one of the selected even or odd shell transporting cavities into the shell pick up position of the gun.

Because of this configuration, which provides rapid shifting between ammunition types, during firing as one type of shell is continuously fed to the gun in one set of rotor cavities, those several shells of the other type which were previously loaded into the other set of rotor cavities are continually rotationally carried along.

Although this type of single rotor, dual shell feeder has important advantages, possible or potential disadvantages are associated with continually rotating several shells of the type not being fired as the fired type of shells are being fed. For example, if the gun is an antiaircraft type, most of the time, in combat, the gun will be firing HE shells at enemy aircraft. All this time, the rotor continually carries along several (three, as disclosed) AP shells which may be considered "excess" shells. These excess shells add weight to the rotor, thereby increasing inertial loading during rotor rotational starting and stopping. This additionally stresses the rotor and related feed parts. Under some adverse conditions, such as when the gun is extremely dirty, the weight added to the rotor by the excess shells might also cause reduction of rotor rotational velocity, with corresponding reduction of gun firing rate.

Furthermore, there may exist a remote possibility that the continual, high speed rotation of the excess shells, as the other type shells are fired, with the associated repeated high accelerations and decelerations as rotor rotation starts and stops, may eventually damage or degrade the excess shells. If this should occur, upon subsequent shell-type changeover, these excess shells may fail to fire properly and cause gun jamming.

In light of such possible, though not necessarily likely, problems, the applicant has invented an improved, single rotor, dual shell feeding apparatus. Instead of rotatably storing several excess shells of the type not being fired, applicant's new apparatus transfers the excess shells from the rotor into a small, intermediate or temporary shell magazine which may be termed a shell accumulator. When firing of one type of shell is stopped and the other type of shells is selected for firing, shells of the type just fired are transferred out of the rotor into one portion of the shell accumulator. Simultaneously, shells of the type just selected for firing are transferred back into the rotor from another portion of the shell accumulator so that firing can then commence. This shell transferring into and out of the shell accumulator occurs at the same time that the feeding apparatus is set up for rotor rotation in the opposite shell feeding direction to that which had just been used to feed the other type of shells.

As a consequence, during firing of the gun, only shells of the type actually being fired are rotationally carried by the rotor. Those several "advance" shells of the type not being fired remain held in the shell accumulator awaiting loading back into the rotor when a subsequent shell type change selection is made.

SUMMARY OF THE INVENTION

According to the present invention, dual shell feeding apparatus for an automatic gun or the like having a shell pick up position to which shells are fed for subsequent picking up and loading into a gun firing chamber for firing, and having associated first and second shell supplies located relatively adjacent the shell pick up position, comprises feeding means mounted intermediate the first and second shell supplies and the shell pick up position and configured for transporting, during firing of the gun, shells from either selected one of the first and second shell supplies to the shell pick up position.

Included are selecting means for prefiring selection of from which one of the first and second shell supplies the feeding means will feed shells to the shell pick up position during a next gun firing sequence. Means are provided for stopping firing of the gun with at least one shell from the shell supply feeding the gun left in the feeding means. Shell accumulator means are included for removing, whenever feeding of the gun is selectively changed by the selecting means from one shell supply to the other, from the feeding means shells left therein, and for storing those shells until the next time the selecting means reselects the shell supply corresponding thereto. Thereupon, the shells are transferred from the accumulator means back into the feeding means for feeding thereby to the gun for firing.

A rotor having means defining a plurality of shell transporting cavities around the periphery thereof is included in the feeding means, as are means rotatably mounting the rotor relative to the first and second shell supplies and the shell pick up position so that when any one of the rotor cavities is in shell feeding relationship with the shell pick up position, another one of the rotor cavities is in shell receiving relationship with the first shell supply and still another one of the rotor cavities is in shell receiving relationship with the second shell supply. The feeding means also includes means cooperating with the selecting means, and during firing of the gun, for rotatably stepping the rotor in a first rotational direction for feeding shells from the first shell supply to the shell pick up position and in a second, opposite rotational direction for feeding shells from the second shell supply to the shell pick up position. Further included are means for transferring shells from only the first shell supply into indexed rotor cavities when the rotor is stepped, during firing, in the first direction and only from the second shell supply when the rotor is stepped, during firing, in the second direction.

Direction of shell transferring rotor rotation during a next firing sequence is selectively set by the selecting means. Thus, the shell supply corresponding to the selected direction of shell transferring rotor rotation is thereby selected for feeding the gun during the next firing sequence. Prefiring selection, by the selecting means, of a different one of the shell supplies for a next firing sequence causes transfer of shells between the accumulator means and the feeding means.

Comprising the accumulator means are first and second shell accumulator portions for receiving and temporarily storing shells left in the rotor cavities from the first and second shell supplies, respectively, according to which shell supply had been feeding the gun just prior to selecting the other supply for feeding. Means are included for automatically transferring shells from the second shell accumulator portion back into the rotor and shells from the rotor into the first shell accumulator portion when the first shell supply is selected. The opposite occurs when the second shell supply is selected. Therefore, shells are stored only in one of the two shell accumulator portions at any time, the shells stored being from the supply not then feeding the gun. As a result, selecting a different shell supply is operative for unloading from the rotor cavities into the accumulator means shells from the last selected supply and loading into the rotor cavities, from the accumulator means, shells from the just selected supply. With shells from the selected supply now loaded back into the rotor, the gun is instantly ready for firing without recharging.

Preferably, the rotor is formed having four shell holding cavities, firing being started with two shells in the rotor. During firing, the rotor is rotatably stepped in 90 degree increments for each shell fed to the pickup position. Firing is stopped with two shells from the feeding supply left in the rotor.

Responsive to setting a changed rotor rotational direction, and hence shifting to feeding the gun from the other supply, the rotor is rotated through 180 degrees to transfer the two shells left in the rotor into the shell accumulator. Simultaneously, and responsive to a toggle member included in the accumulator means, two shells held in the other portion of the accumulator are loaded into the rotor.

Rotational stepping of the rotor during shell feeding may be provided by a rotary piston driven by barrel gases caused by firing of the gun. A ratchet interconnection between the rotary piston and the rotor enables reciprocating piston action, with each firing, while the rotor continues to be stepwise rotated in the selected rotational direction.

Because prefiring changing the rotor feeding direction, to feed from the shell supply other than the one just used for feeding the gun, is operative for extracting or transferring the shells left in the rotor cavities at the end of the preceeding firing sequence into the shell accumulator, at the same time shells from the just selected supply are fed from the accumulator into the rotor for the next firing, the gun is immediately ready for firing after the selection is made. Furthermore, during firing, the rotor transports only shells from the selected supply, preferably through only 90 degrees with each shell fired. Hence, no excess rotor loading is provided.

Thus, parts reliability is expected to be improved over that of previously known single rotor dual shell feeders. Also, the shells, preferably two, held in the accumulator awaiting a next shifting between shell supplies, are subjected only to the usual firing shock and vibration to which other shells are subjected.

These "accumulated" shells are not subject to the possible gradual degradation to which they might be subject were they continually rotated in the rotor while shells from the other supply were fed and fired.

For this reason also, reliability of the gun system is expected to be improved.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
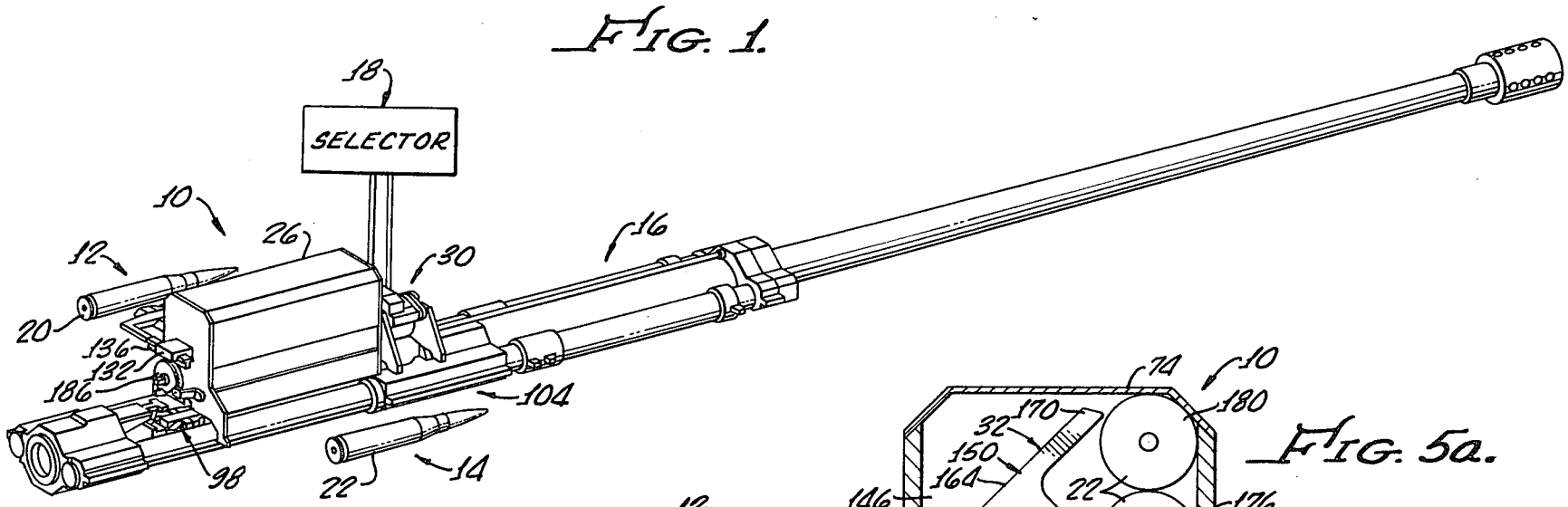
FIG. 1 is a partially cutaway perspective drawing of an automatic gun shown having mounted thereto a dual shell feeding apparatus according to the present invention and showing portions of associated first and second shell supplies each capable of holding a different type of shell.

In FIG. 1, a dual, two stage shell feeding apparatus 10, according to the present invention, is shown mounted for feeding shells from laterally spaced apart, first and second shell supplies or supply means 12 and 14, respectively, to an associated gun 16. Although the dual shell feeding apparatus 10 is readily adaptable, in a manner which will become apparent to those shilled in the related arts, to virturally any type and calibre of gun, the gun 16 is shown, for illustrative purposes with no limitations intended or implied, to be a rapid firing, open framework receiver automatic cannon of the type disclosed in U.S. Pat. No. 4,269,109. The gun 16 may be of 35 mm calibre, being particularly adapted by the dual shell feeding apparatus 10 for both antiaircraft and antitank use. Accordingly, the gun 16 may be part of a more extensive weapons system, not shown.

Also forming part of the dual shell feeding apparatus 10, as more particularly described below, are feed selector control means 18 for enabling rapid selection between firing of first and second types of shells 20 and 22, respectively, from the corresponding first and second shell supplies 12 and 14. Selective use of the different shells 20 and 22 against different types of targets is thereby enabled. Alternatively, in necessary or desired, both the shell supplies 12 and 14 may be used to contain a single type of shells, thereby providing extended shell capacity, shell feeding operation of the apparatus 10 being completely independent of type of shells being fed thereby.

Figure 2:
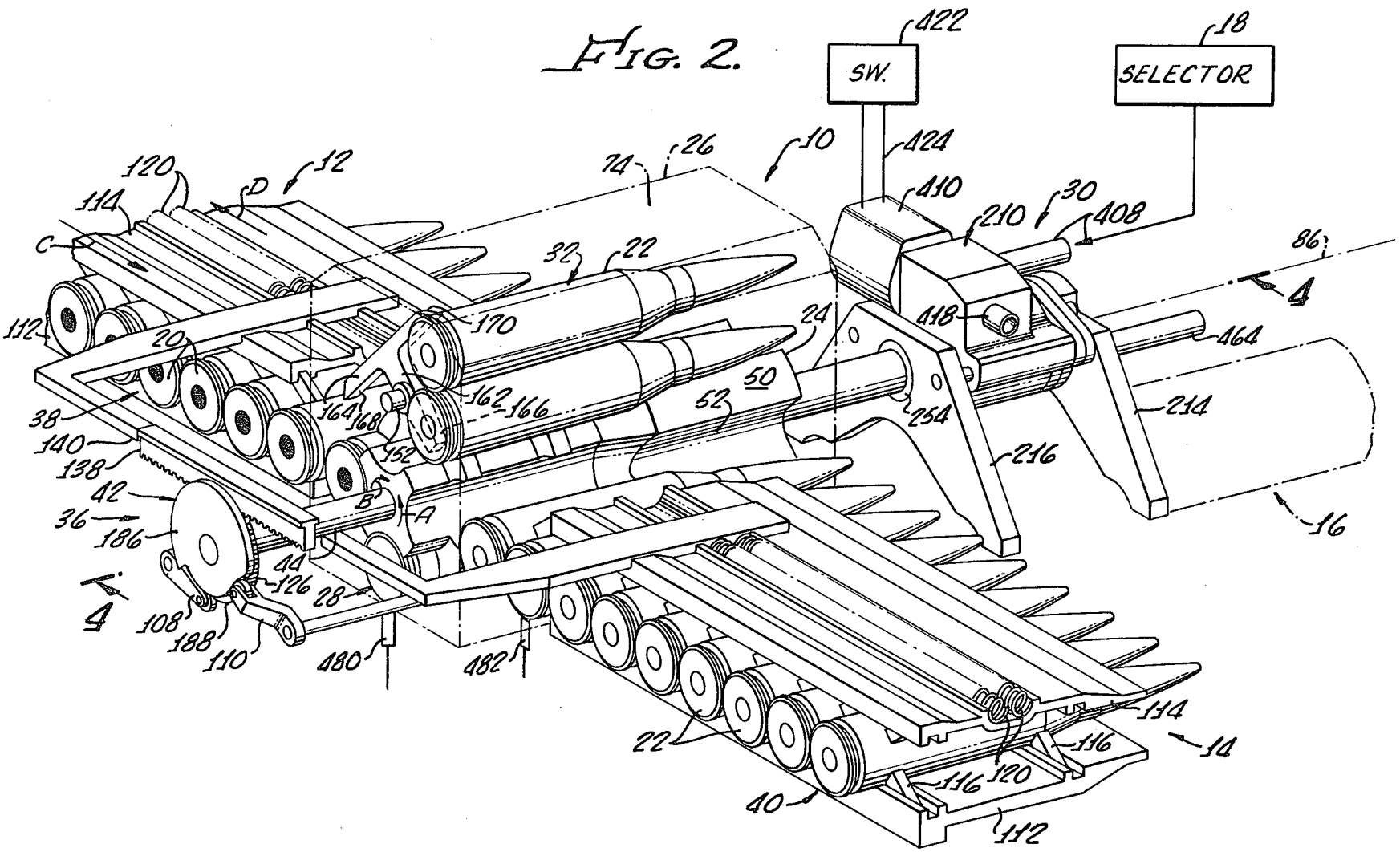
FIG. 2 is partially cutaway perspective drawing of the dual shell feeding apparatus of FIG. 1, showing an exemplary shell feeding rotor having four shell holding cavities, a shell accumulator having two portions each capable of holding two shells and rotor control means, and showing the apparatus set for feeding shells from a first one of the two shell supplies.

More particularly shown in FIG. 2, the dual shell feeding apparatus 10 includes a first stage shell transferring rotor or rotor assembly 24 and rotor mounting means 26 for rotatably mounting the rotor, in shell feeding relationship, between the first and second shell supplies 12 and 14 and the gun 16. As described below, the rotor 24 is stepped or indexed in a first rotational direction (direction of Arrow "A") to rotatably transfer shells 20 from the first shell supply 12 to a shell loading or pick up position 28 and in a second, opposite rotational direction (direction of Arrow "B") to transfer shells 22 from the second shell supply 14 to the same shell pick up position. Rotor rotational control and drive, also as described below, is provided by a pressure actuated rotational direction control and rotor drive portion or means 30 which is connected, forwardly, to the rotor 24 (FIGS. 1–4) and also to the control means 18. Comprising an important part of the dual shell feeding apparatus is a temporary shell storage magazine or shell accumulator means 32, which, as described below, is configured for receiving and temporarily storing shells 20 or 22 left in the rotor 24 whenever firing is stopped. As a result of providing the shell accumulator means 32, only shells from whichever one of the shell supply 12 or 14 is actually feeding the gun during firing are rotated by the rotor. Shells left in the rotor 24 after the last firing of shells from the other supply, and which were transferred into the accumulator means 32 when the shell supply shift was made, are held in the accumulator means until the next time that supply is selected. At that time, and in response thereto, shells are transferred between the rotor 24 and accumulator means 32 so that only shells from the newly selected shell supply are held in the rotor.

Figure 4A:
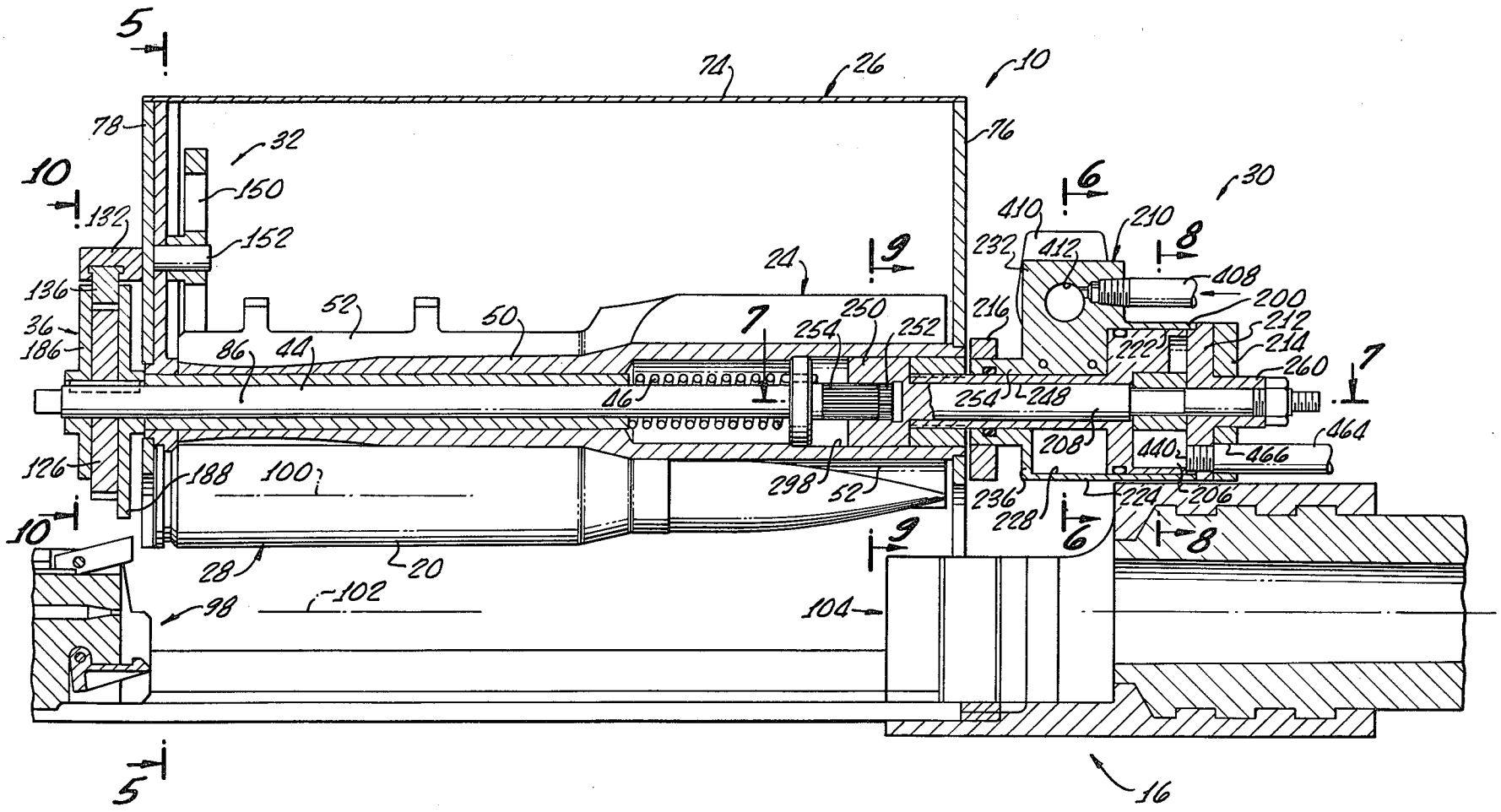
FIG. 4 is longitudinal sectional view, taken along line 4—4 of FIG. 2, FIG. 4*a* showing the rotor set for feeding shells from the first shell supply.
FIG. 4*b* showing the rotor set for feeding shells from the second shell supply.

Still generally described, second stage shell feeding from the shell supplies 12 and 14 into the rotor 24 is provided by second stage feeding means 36. Comprising the second stage feeding means 36 are first (left) and second (right) shell advancing or transferring means 38 and 40, respectively, associated with corresponding ones of the first and second shell supplies 12 and 14 (FIG. 2). Actuation of the shell transferring means 38 and 40 is by second stage actuation means 42 operatively interconnected with a rotor mounting shaft 44 about portions of which is installed a return rotation spring 46 (FIG. 4*a*).

For transferring shells from whichever of the shell supplies 12 and 14 is selected into the shell pick up position 28, the rotor 24 includes a rotor housing 50 (FIGS. 2–5) having means defining a plurality of spaced apart, longitudinally extending, peripheral shell holding cavities 52, four being shown for the exemplary apparatus 10. In operation, as described below, rotational transfer of both shells 20 from the first shell supply 12 and shells 22 from the second shell supply 14 into the pick up position according to the shell supply selected, is by the same cavities 52.

Figure 5A:
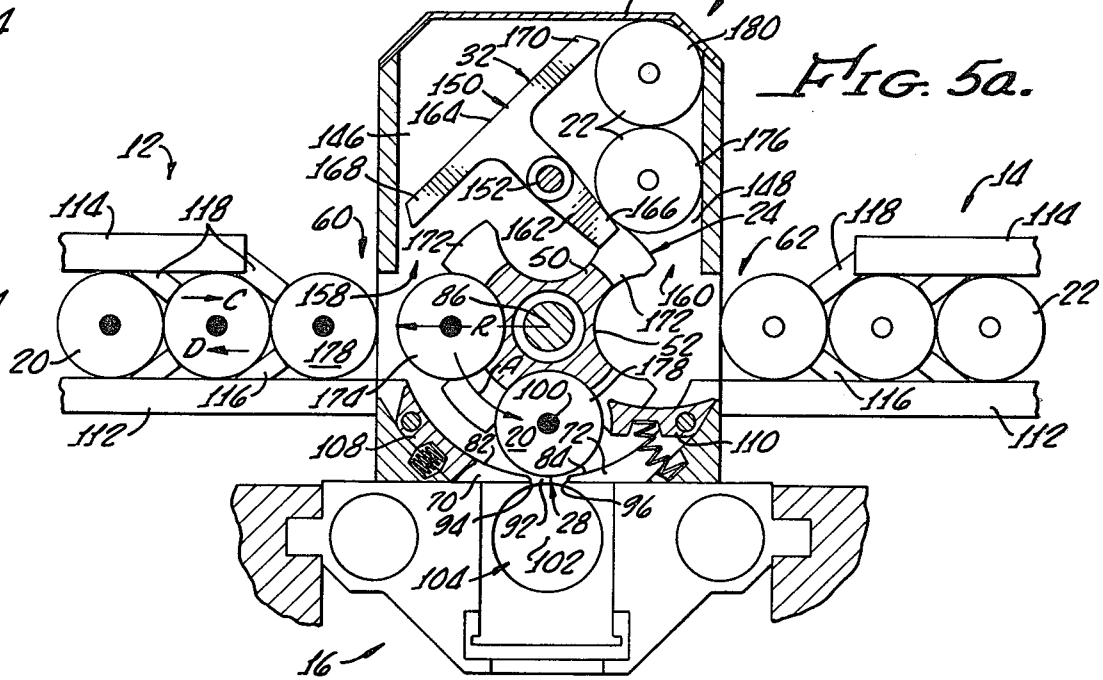
FIG. 5 is a transverse cross sectional view, taken along line 5—5 of FIG. 4*a*, FIG. 5*a* showing the rotor loaded for feeding shells from the first shell supply and showing shells from the second shell supply loaded into the shell accumulator, FIG. 5*b* showing an intermediate stage in shifting between feeding from the first to feeding from the second shell supply, one shell from each supply being loaded in the rotor and one from each supply being loaded in the accumulator, and FIG. 5*c* showing the rotor loaded for feeding shells from the second shell supply and showing shells from the first shell supply loaded into the shell accumulator.
Figure 5B:
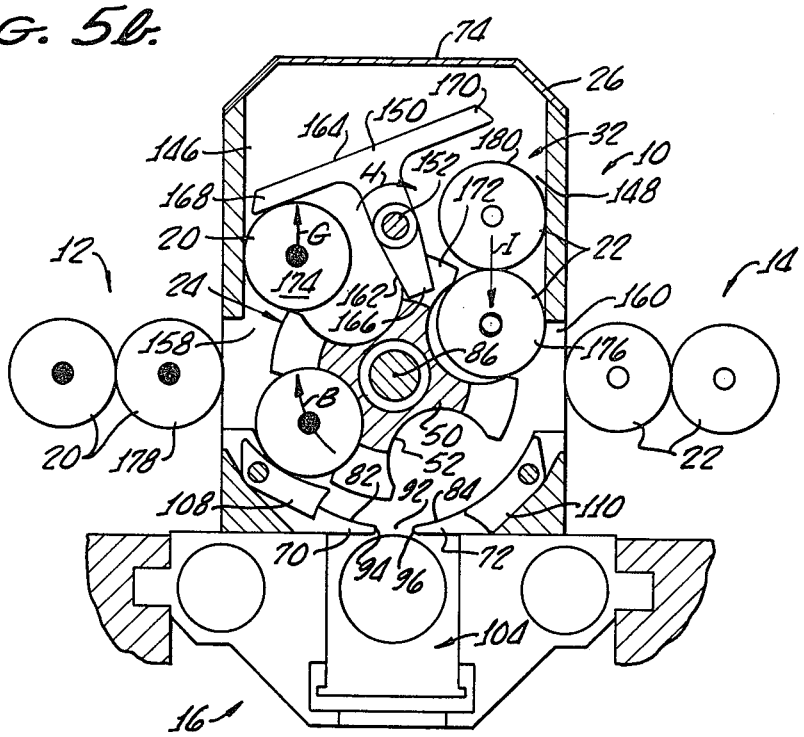
Figure 5C:
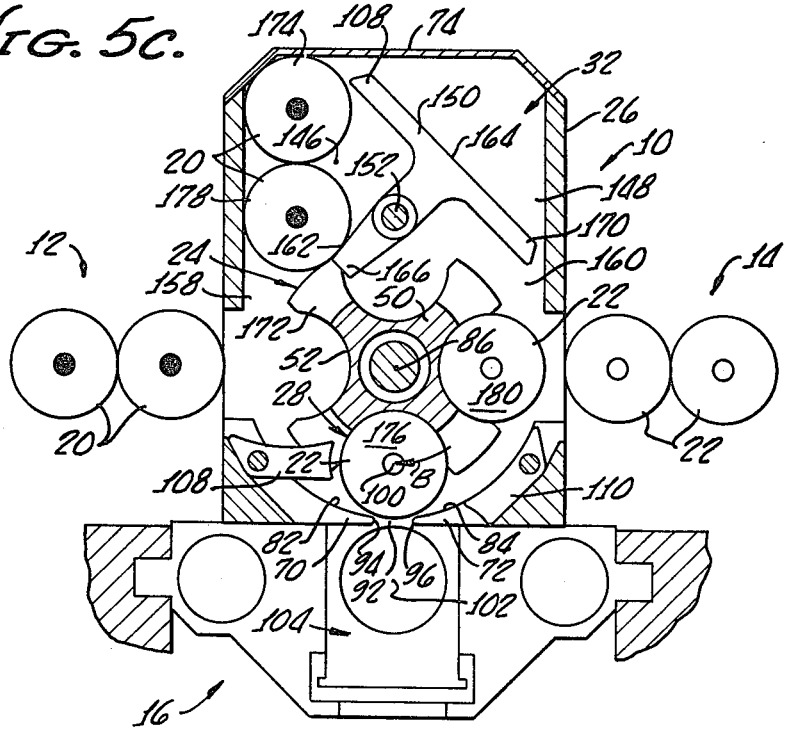

Size, particularly diameter, of the rotor housing 50, as well as relative positioning between the rotor 24, the first and second shell supplies 12 and 14 and the gun shell pick up position 28 is selected to cause, whenever one of the shell holding cavities 52 is indexed into the pick up position, another (adjacent) one of the cavities to be indexed into shell receiving relationship, or aligned, with a shell outfeed region 60 of the first shell supply 12 (FIG. 5(*a*)). Still, another one of the cavities is then indexed in shell receiving relationship, or aligned, with a shell outfeed region 62 of the second shell supply 14.

Because of use, in the exemplary configuration of four rotor cavities 52, the cavities are spaced at 90° intervals around the rotor housing 50, and the first and second shell supply outfeed portions 60 and 62 are each located at angles of approximately 90° to opposite sides of the shell pick up position 28.

Rapid shifting between feeding the gun 16 from the first and from the second shell supplies 12 and 14 is enabled by maintaining the rotor 24 loaded with two shells from the feeding supply (for the four cavity rotor 24) whenever firing is stopped, and by keeping two shells (also for the four cavity rotor) temporarily stored in the accumulator means 32. And, as described below, by rotating the rotor 24 counterclockwise, as seen in FIG. 5(*a*) (direction of Arrow "A") for feeding the gun 16 from the first shell supply 12 and clockwise, as seen in FIG. 5(*c*) (direction of Arrow "B") for feeding from the second shell supply 14, shells from both supplies being fed by the rotor cavities 52.

It is to be appreciated that while four rotor cavities is considered to be optimum, additional rotor cavities may be provided for particular configurations; however, the capacity of the accumulator means 32 for each shell supply should be equal to the number of shells left loaded in the rotor when firing is stopped. Thus for the four cavity rotor wherein two shells are left loaded in the rotor, the accumulator means 32 is configured, as described below, to alternately hold two shells from either supply, only two shells being held at any one time in the accumulator means, however.

Forming sides and bottom of the rotor mounting means 26 are rigid, laterally spaced apart first and second feed lip members 70 and 72, respectively, (FIG. 5). An upper transverse member 74 (FIGS. 4 and 5) forms the top of the rotor mounting means 26. Opposite ends of the members 70, 72 and 74 are rigidly fixed to forward and rearward transverse rotor mounting end plates 76 and 78, respectively.

During shell feeding rotor rotation the shells 20 or 22 in the rotor cavities 52 are contained in the rotor cavities by adjacent, arcuate inner surface regions 82 and 84, respectively, of the feed lip members 70 and 72. Radius of the surface regions 82 and 84 is slightly greater than a radius "R" (FIG. 5(*a*)) from a longitudinal rotor axis 86 to extreme outer surface regions of shells 20 or 22 held in the rotor cavities 52, such surface regions being positioned closely adjacent to the shell outer surface regions.

A bolt clearance gap 92 between adjacent opposing side edges 94 and 96, respectively, of the feed lip members 70 and 72 (FIG. 5) adjacent the shell pick up position 28, provides clearance for pick up portions of a bolt assembly 98 (FIG. 1) during shell stripping. Since a longitudinal axis 100 of shells in the pick up position 28 is offset above a barrel bore axis 102, the width of the gap 92 must increase in a forward direction so that shells forwardly stripped by the bolt are enabled to move inwardly, between forward regions of the feed lip members 70 and 72, towards the barrel bore axis and then to move forwardly towards a gun breech 104 (FIGS. 1, 4 and 5). Feed path control may additionally be provided for the shells from the pick up position 28 to the breech 104 by rotor cavity and feed lip member configuration in a manner described in the copending U.S. Pat. application Ser. No. 89,308 now U.S. Pat. No. 4,348,938 issued Sept. 14, 1982.

First and second, spring loaded pawls 108 and 110, respectively, mounted at opposite side edge regions of the rotor housing 50 inwardly adjacent to the shell supply outfeed regions 60 and 62 (FIG. 5), prevent unintended shell movement from the shell supplies 12 and 14 into the rotor 24. Also, importantly, the pawls 108 and 110 prevent transfer of shells from the rotor 24 back into the shell supplies 12 or 14 when shells are being transferred between the rotor and the accumulator means 32.

Shells advancing from the selected one of the shell supplies 12 or 14, past the pawls 108 and 110, into indexed rotor cavities 52 is enabled by the left and right, second stage shell transferring means 38 and 40 and the second stage actuating means 42. Second stage shell transferring is thereby also responsive to rotor rotation.

As seen in FIGS. 2 and 5*a*, the left shell transferring means 38 comprises generally a fixed lower track 112 and a slidable upper track 114 between which the shells 20 are fed from the first shell supply 12 towards the outfed portion 60 and the rotor 24. The fixed track 112 may, as illustrated, be generally U or V-shaped, so as to wrap partially around the shells 20, thereby providing underneath shell support and also slidably mounting the track 114 in a manner enabling it to slide a limited distance inwardly and outwardly relative to the rotor 24 during shell transferring to the rotor. The fixed track 112 may be independent from the shell supply 12 or be formed as part thereof, according to the type of shell supply. If for example, the shell supply 12 is in drum form, the fixed track 112 may comprise a wall portion of the drum segment, each segment being constructed with an associated pair of tracks 112 and 114. Alternatively, if the shell supplies 12 and 14 are in belt form, the track 112 may be formed as a fixed or detachable, sidewardly projecting, round stripping portion of the feeding apparatus.

Several pairs of spring loaded bottom pawls 116, pivotally mounted to the fixed track 112, project generally upwardly and inwardly, at about 45°, towards the rotor 24 at shell spacing intervals. By downwardly deflecting against their springs, the bottom pawls 116 enable the shells 20 to be moved inwardly towards the rotor 24 in a shell loading direction (direction of Arrow "C", FIG. 2). However, when in their normal, raised position, the bottom pawls 116 prevent backing up of the shells 20 away from the rotor 24.

Spring loaded upper pawls 118 are correspondingly mounted to the upper, slidable track 114 to project downwardly and inwardly at about 45°. By upwardly deflecting against their springs, the upper pawls 118 enable the track 114 to be pushed outwardly over the shells 20 away from the rotor 24 (direction of Arrow "D", FIG. 2) by the actuation means 42, as described below. However, as the track 114 then returns inwardly back towards the rotor 24 (direction of Arrow "C"), the upper pawls 118 push, by action of springs 120, the shells 20 engaged thereby in the loading direction to cause the endmost shell to be advanced into an adjacent, indexed empty one of the rotor cavities 52.

Inasmuch as the right hand shell transferring means 40 associated with the second shell supply 14, is preferably a mirror image of the above described left hand shell transferring means 38 associated with the first shell supply 12, the right hand shell transferring means is not separately described, both the shell transferring means operating in an equal and opposite manner, but independently of one another.

Shell advancing movement of the sliding track 114 is coordinated to rotation of the rotor 24 by the second stage actuating means 42 (FIGS. 1, 2 and 10) which is operated in unison with rotation of the rotor shaft 44. Included in the second stage actuation means 42 is a drive gear 126 directly fixed to a rearward end of the rotor shaft 44 rearwardly of the rear end plate 78.

Transversely, slidably mounted through sides of a support bracket 132 (FIG. 10), in driven meshed relationship with the drive gear 126, is rack-type member 136. As the rotor shaft 44, and with it the drive gear 126, is rotated counterclockwise, (direction of Arrow "A"), FIG. 2, for feeding from the first shell supply 12, the member 136 is driven outwardly towards the first shell supply 12, (direction of Arrow "D").

Construction of the actuation member 136 relative to the slidable track 114, is such that a first end 138 of the member is in pushing engagement with an inner end portion 140 thereof. As a result, outward movement of the actuation member 136 towards the first supply 12, in response to rotor shaft rotation, also pushes the track 114 outwardly, compressing the associated drive springs 120. Immediate return rotation of the rotor shaft 44, as described below, with simultaneous return of the actuation member 136 to its initial position enables the drive springs 120 to push the sliding track 114, and with it the shells 20 engaged by the upper pawls 118, in the shell advancing direction of Arrow "C" (FIG. 2) to transfer an end one of the shells 20 into whichever one of the rotor cavities 52 is aligned therewith.

In an opposite manner, as the rotor shaft 44 is rotated clockwise, (direction of Arrow "B") to feed the gun 16 from the second shell supply 14, the actuation member 136 is driven outwardly theretowards (direction of Arrow "C"). This outward movement of the member 136 drives the sliding track associated with the second shell supply 14 outwardly, compressing the associated drive springs. When the actuation member 136 returns to its initial position, by return rotation of the rotor shaft 44, the drive springs drive the sliding track 114 and the shells 22 engaged thereby towards the rotor 24 to transfer an end shell into whichever one of the rotor cavities 52 is aligned therewith.

Accordingly, when the first shell supply 12 is selected for feeding the gun 16, the rotor cavities 52 transfer, in 90° incremental, counterclockwise steps (direction of Arrow "A"), the shells 20 from the first shell supply into the pick up position 28 for picking up, loading and firing by the forwardly traveling bolt assembly 98. In a contrary manner, when the second shell supply 14 is selected, the rotor cavities 52 transfer, in 90° incremental, clockwise rotor steps (direction of Arrow "B"), the shells 22 from the second shell supply into the pick up position 28, for picking up, loading and firing by the bolt assembly.

When feeding from either selected one of the shell supplies 12 and 14, as further described below, during first stage shell feeding, and responsive to each firing of the gun 16, a next shell from the selected shell supply already loaded into the rotor 24 is rapidly rotated into the shell pick up position 28. During subsequent second stage shell feeding, before a next gun firing, an end shell from the selected shell supply 12 or 14 is advanced into an indexed one of the empty rotor cavities 52.

Selection between feeding of the gun 16 from the first or second shell supply 12 or 14 is done by selecting the direction of rotor rotation. Such selection or rotor rotational direction, when shifting from one of the shell supplies 12 or 14 to the other, includes indexing the rotor 24 two cavity spacings, that is, 180°, in the direction of selected rotor rotational direction prior to firing. This 180° prefiring rotor rotation importantly causes transfer from the rotor 24 into the accumulator means 32 of the two shells (one shell for each 90° of rotor rotation) left in the rotor when firing from the previously selected shell supply stopped, and transfer into the rotor from the shell accumulator means of the two shells previously loaded thereinto the last time firing from the just selected shell supply stopped. After this prefiring, 180° rotor indexing, with each shell fired during the next firing sequence, the rotor 24 is indexed in 90° increments, in the appropriate direction, according to shell supply selected, to index successive shells loaded into the rotor to the shell pick up position 28.

To enable rapid shifting between feeding from either of the two shell supplies 12 and 14, the shell accumulator means 32 is always kept loaded with two of the shells from the shell supply other than the supply just selected for firing. To this end, prefiring charging of the gun 16 is accomplished by cycling the actuation member 136 twice by charging means (not shown), in a direction loading shells into the rotor from the shell supply not expected to be fired first. Reverse rotor rotational direction is then set, the resulting 180° of rotor rotation transferring the two shells just loaded into the shell accumulator means 32. Then the gun 16 is charged twice more to load two shells from the shell supply expected to be next fired from into the rotor 24. At this point the gun is ready for firing. Subsequently, the rotor 24 is kept fully loaded at the end of each firing by following the bolt searing up operation described in my copending U.S. Pat. application, Ser. No. 089,308 now U.S. Pat. No. 4,348,938 issued Sept. 14, 1982. Thus, when the rotor 24 is loaded with two shells, from one of the supplies 12 or 14 and the shell accumulator means is loaded with two shells from the other shell supply, any prefiring, 180° indexing of the rotor 24, in either direction, to change feeding of the gun 16 from one of the shell supplies 12 or 14 to the other, will always result in indexing a shell from the selected shell supply into the shell pick up position 28, with no additional charging being required.

Comprising the shell accumulator means 32, as best seen in FIGS. 5(*a*)–5(*c*), are separate, but adjacent, first and second shell accumulator portions 146 and 148, respectively, and a T-shaped toggle member 150 pivotally mounted, on a pin 152, therebetween. Each of the first and second accumulator portions 146 and 148, in accordance with the illustrative four cavity rotor 24, is configured to hold two shells, the first portion 146 for holding two shells from the first shell supply 12 and the second portion 148 for holding two shells from the second shell supply 14. Both first and second accumulator portions 146 and 148 are magazine clip-type in configuration, with respective shell base receiving grooves (not shown).

Infeed/outfeed regions 158 and 160 of the respective first and second accumulator portions 146 and 148 are each tangentially aligned with the rotor cavities 52 so that shells 20 or 22 can be directly transferred between the rotor 24 and the accumulator portions, base of the shells sliding into and out of the base receiving grooves (not shown). Relative orientation of the first and second accumulator portions 146 and 148 is such that shells are loaded into the rotor from the first accumulator portion 146 and from the rotor into the second accumulator portion 148 when the rotor is rotated in the counterclockwise direction (direction of Arrow "A") to select that rotational direction for feeding shells from the first shell supply 12. This configuration is consistent with the opposite situation in which shells are fed into the rotor 24 from the second accumulator portion 148 and from the rotor into the first shell accumulator portion 146 when the rotor is rotated clockwise (Arrow "B") to select that rotational direction for feeding from the second shell supply 14.

Simultaneous loading of shells from the rotor 24 into one of the accumulator portions 146 and 148 and from the other one of the accumulator portions into the rotor is enabled and controlled by the toggle member 150. As can be seen in FIG. 5, the toggle member is formed having a "vertical" leg 162 and a "transverse" arm 164, the vertical leg bisecting the transverse arm. Pivotal mounting of the member 150 by the pin 152 is in a generally central region of the vertical leg 162.

Length of the vertical leg 162 and mounting of the member 150 by the pin 152 is such that in either extreme pivotal position of the member (FIGS. 5(*a*) and 5(*c*)) a lower end region 166 of such leg extends into regions of the rotor cavities. In either of these extreme member positions, left or right (as seen in FIG. 5) ends 168 or 170 of the transverse arm 164 are positioned across the corresponding first or second accumulator infeed/outfeed regions 158 or 160.

Relative lengths of the vertical leg 162 and the transverse arm 164 are such that when two shells are loaded into either of the accumulator portions 146 or 148 and the toggle member 150 is at its corresponding extreme rotational position (FIG. 5(*a*) or 5(*c*)), the two shells are confined between the vertical leg lower region 166 and one of the left or right transverse arm ends 168 or 170. Hence, the shells are retained in the accumulator portion into which they were loaded from the rotor.

As can be seen from FIGS. 5(*a*) and 5(*c*), when the member 150 is in either of its extreme positions, such that the vertical leg lower region 166 extends into rotor cavity regions, this extension is into an area of the rotor through which shells are not fed. Thus, during rotor-shell feeding, there is no interference between shells being fed and the toggle member 150. Clearance is provided between the toggle member end region 166 and the rotor 24 by providing clearance slots 172 in the rotor.

Prefiring rotation of the rotor 24 through 180° in the direction selected for rotation during the next firing sequence, reverse rotates the rotor (from its rotational direction during the previous firing). This backs up the two shells left in the rotor cavities 52 when firing stopped and starts feeding the shell 90° out of the shell pick up position 28 up into the corresponding one of the accumulator portions 146 or 148. As this shell engages the left or right end 168 or 170 of the toggle member transverse arm 164, it pushes upwardly on the arm causing the toggle member 150 to rotate about its pivot pin 152. As this toggle member rotation occurs, the opposite transverse arm end pushes downwardly on the uppermost shell in the other shell accumulator portion, pushing the other shell down into the rotor 24.

Thus, as seen in FIG. 5(*b*), as the rotor 24 is back rotated 90° (direction of Arrow "B") a first shell 174 from the first supply 12 is backed upwardly (direction of Arrow "G") into the first accumulator portion 146, causing the toggle member to rotate clockwise (direction of Arrow "H"). This causes a last loaded shell 176 from the second accumulator portion 148 to be pushed downwardly (direction of Arrow "I") into the rotor.

An additional 90° of rotor rotation loads a second shell 178 from the first supply 12 upwardly into the accumulator portion 146 and a first loaded shell 180 from the second accumulator portion 148 downwardly into the rotor 24, (FIG. 5(*c*)). During this complete accumulator loading/unloading, corresponding to 180° rotor rotation, the toggle member rotates through approximately 90°.

Figure 10:
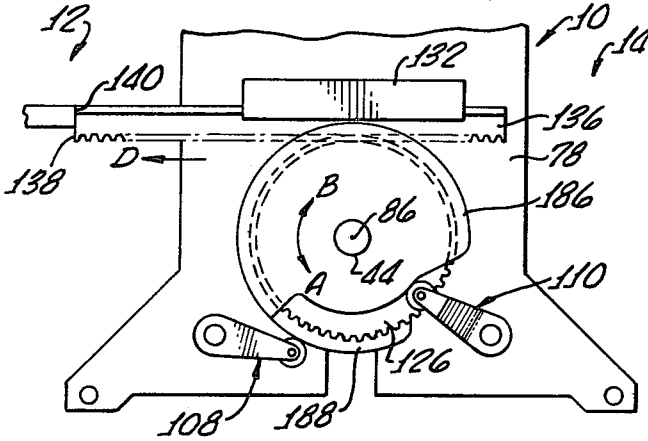
FIG. 10 is a transverse cross sectional view taken along line 10—10 of FIG. 4*a*, showing two rotor overdrive pawls, set for enabling the rotor to feed shells from the first shell supply and showing in phantom lines the pawls set for feeding from the second shell supply.

Associated with the rotor 24, and responsive to the prefiring 180° rotor rotation causing shell transferring between the rotor and the shell accumulator means are the first and second, spring loaded shell overdrive pawls 108 and 110, respectively, (FIGS. 5 and 10). Mounting of the first overdrive pawl 108 is to prevent overdriving or over rotation of the rotor 24 when the rotor is rotated in the counterclockwise direction (Arrow "A") to feed shells 20 from the first shell supply. The second pawl 110 is mounted to prevent clockwise overdrive of the rotor 24 during feeding of shells 22 from the second supply 14.

Preferably, as shown in FIG. 10, an arcuate overdrive pawl retractor cams 186 and 188 are fixed to the rotor drive shaft 44 so that, according to the direction of rotor rotation selected for the next firing sequence, the appropriate one of the pawls 108 and 110 is retracted by the cams. Thus, for counterclockwise rotor rotation for feeding from the first shell supply 12, the second pawl 110 is retracted and for clockwise rotor rotation for feeding from the second shell supply 14, the first pawl 108 is retracted by the cams.

Shell feeding by the apparatus 10 thus depends, first, on prefiring, 180° indexing of the rotor 24 to select from which of the two shell supplies the gun 16 is to be fed, and to appropriately transfer shells between the rotor 24 and the shell accumulator portions 146 and 148 and then, during firing, on repetitive, 90° incremental indexing of the rotor 24 in the appropriate direction to transfer shells from the selected shell supply into the shell pick up position 28.

These important rotor driving functions are provided by the rotor rotational direction control and rotor drive means 30. Pressurized fluid from the selector control means 18 is used to cause prefiring, 180° rotor indexing and exchange of shells between the rotor 24 and the accumulator means 32 and also to establish or "set" a corresponding feeding rotational direction of the rotor during a next firing sequence. During firing, pressurized barrel gas is fed to the control and drive means 30 to cause the 90° incremental rotor rotation for shell feeding.

In addition, the control and drive means 30 are configured for enabling continuous, 90° stepwise incrementing of the rotor 24, during firing, by reciprocating rotational movement of the rotor shaft 44. Accordingly, the control and drive means 30 also provides, as described below, for a bidirectional ratcheting interconnection between the rotor 24 and the rotor shaft 44.

As seen in FIGS. 3, 4, 6–9 and 11, the rotor control and drive means 30 comprises generally a first, bidirectionally rotatable piston 200 for 180° prefiring indexing of the rotor to transfer shells between the shell accumulator means 30 and the rotor 24 and for prefiring setting of the direction of rotor rotation during the next firing sequence. Associated with the first piston 200 are first and second axial pistons 202 and 204, respectively, which, as described below, set up, by moving portions of the control and drive means 30 fore or aft, the appropriate rotor-rotor shaft ratcheting to enable continued 90° stepwise rotation of the rotor in the direction selected for shell feeding while the rotor shaft 44 rotationally reciprocates through 90°.

A second rotary piston 206, non-rotatably fixed to a rotor shaft extension 208 forwardly of the first rotary piston 200 and cooperating therewith, provides for 90° stepwise shell feeding indexing of the rotor 24 during firing of the gun 16 and in response thereto. Preferably, the first rotary piston 200 and the two axial pistons 202 and 204 are hydraulically actuated by the selector control means 18; whereas, the second rotary piston 206 is sychronized with firing of the gun 16 by being operated by barrel gas pressure.

Other cooperating portions of the control and drive means 30 includes a main housing 210 into which portions of the first and second axial pistons 202 and 204 are disposed, as is the first rotary piston 200. Also included are a housing forward end cap 212, forward and rearward, generally triangular, end plates 214 and 216, respectively, and rotor ratcheting means 218.

Figure 3:
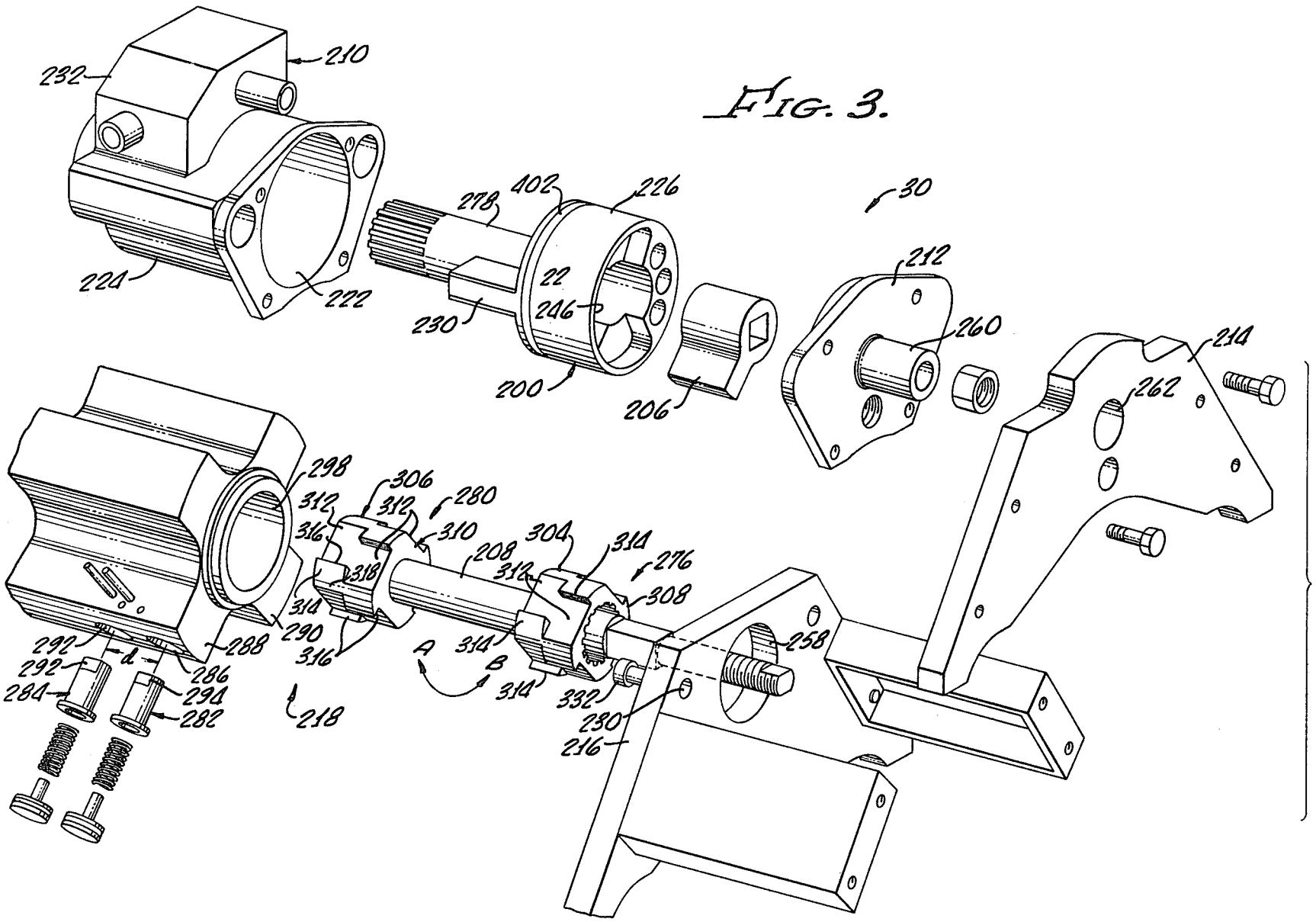
FIG. 3 is an exploded perspective drawing showing rotor rotational direction selection and rotor ratching portions of the shell feeding apparatus.
Figure 6:
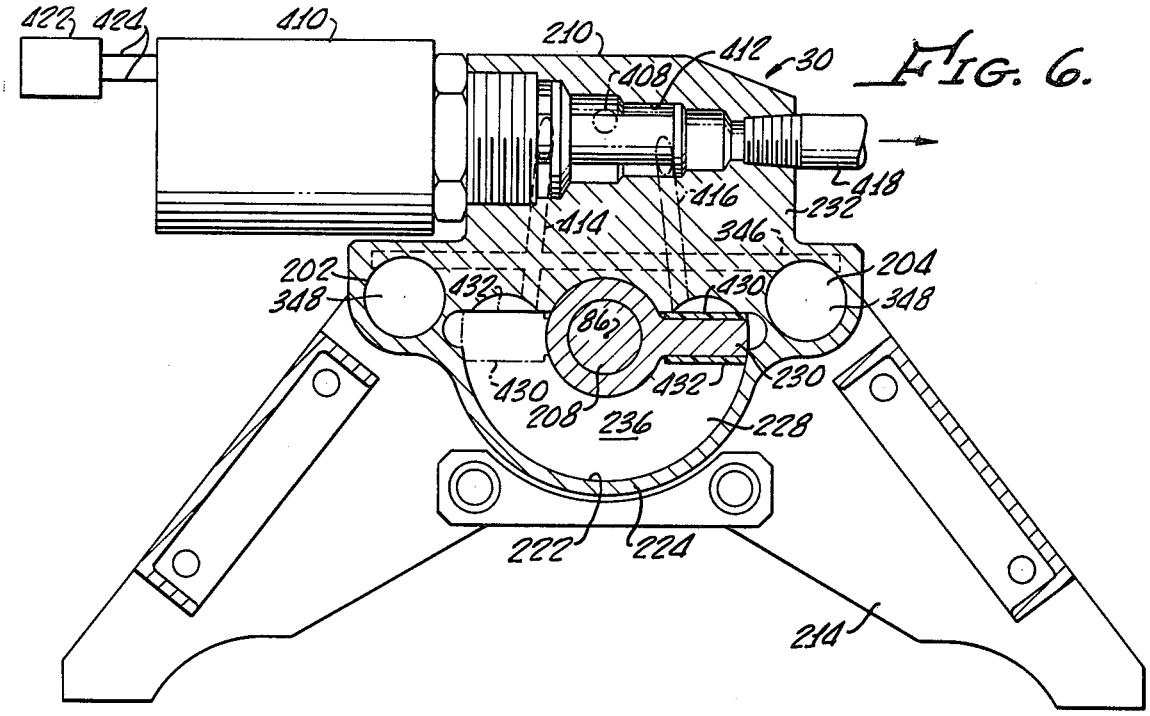
FIG. 6 is a transverse cross sectional view taken along line 6—6 of FIG. 4*a*, showing a first, accumulator feeding rotary piston portion of the rotor control means rotated by hydraulic pressure to a position corresponding to loading the shell accumulator as shown in FIGS. 4*a* and 5*a*; the opposite piston position for feeding from the second shell supply being shown in phantom lines.

As best seen in FIGS. 3, 6 and 8, the housing 210 is formed having a cylindrical recess 222, defined by a peripheral wall 224, opening forwardly for receiving a forward cylindrical portion 226 of the first rotary piston 200. Formed rearwardly more deeply into the housing 210 is a lower, semicylindrical recess 228 for receiving a rearwardly extending vane portion 230 of the first rotary piston 200. Defining the recess 228 in upper regions is an upper housing portion 232; in lower regions the recess is defined of rearward regions of the housing wall 224 and in rearward regions, by a rear wall 236.

In a somewhat similar manner, forward regions of the first piston cylindrical portion 226 has formed thereto a generally semicylindrical recess 244, defined by inner walls 246, for receiving the second rotary piston 206.

Thus, on assembly, the second rotary piston 206 is received into the first rotary piston recess 224, while the entire first rotary piston 200 is received into the housing recesses 222 and 228. As a result, both rotary pistons, 200 and 206 are contained within the housing 210, which, on assembly, is forwardly closed by the end cap 212.

It should be observed that whereas the second rotary piston 206 is non-rotatably fixed to the rotor shaft extension 208, a central aperture 248 formed axially through the first piston 200 and through which the shaft extension passes, enables the first piston to rotate freely relative to the rotor shaft extension. In this manner, rotation of the first and second pistons 200 and 206 are relatively independent of one another, except to an extent described below.

Figure 4B:
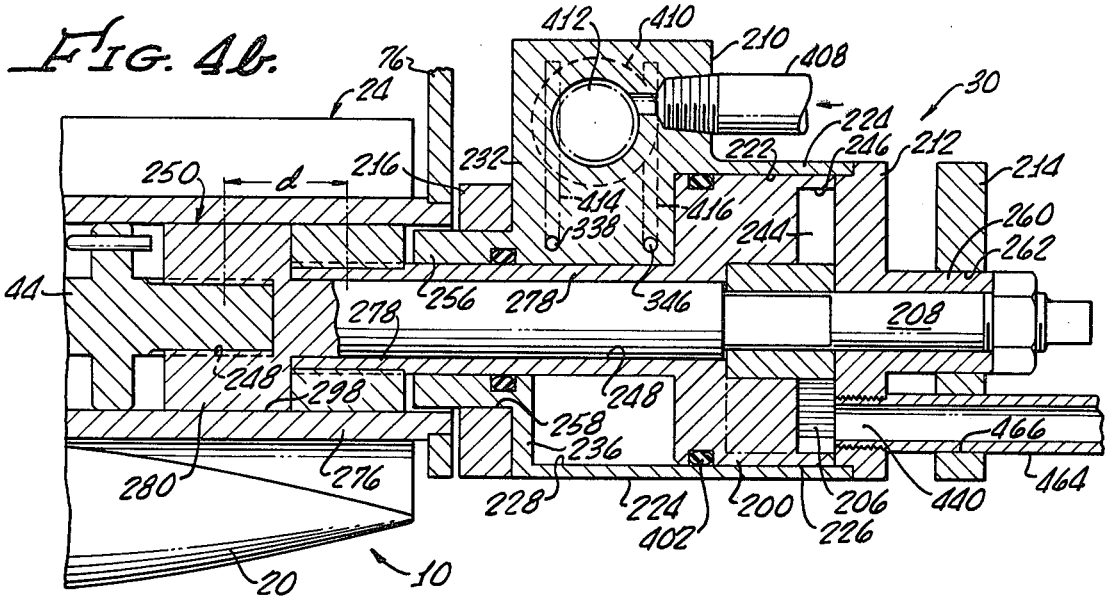

From FIG. 4*b* it can be seen that a rearward region 250 of the rotor shaft extension 208 is formed with an internal spline 252 to mate with a forward externally splined region 254 of the rotor shaft 44. This spline interconnection is made sufficiently long to enable limited axial movement of the shaft extension 208 relative to the shaft 44, for reasons which will hereinafter become apparent.

Mounting of the housing 210 relative to the end plates 214 and 216 is enabled by a tubular, rearwardly extending portion 256 of the housing which fits rearwardly through a mating axial aperture 258 in the rear plate 216 (FIGS. 3 and 4*b*). A forwardly extending tubular region 260 of the end cap 212 extends forwardly through a mating axial aperture 262 in the forward plate 214.

Axial separation between the plates 214 and 216 is such as to enable limited axial movement, established in a manner described below, of the housing 210 and end cap 212 (and hence of the first and second rotary pistons 200 and 206 and the shaft extension 208) relative to the end plate. This limited axial movement of the housing 210, pistons 200 and 206 and shaft extension, is caused by the first and second axial pistons 202 and 204 and control means 18, in conjunction with the ratcheting means 218, the ratcheting and driving action between the first and second pistons 200 and 206 and the rotor 24.

As described below, when the housing 210 and end cap 212, with the pistons 200 and 206 and the shaft extension 208, are driven by the axial pistons 202 and 204 to a forwardmost position, relative to the rotor 24, and the end plates 214 and 216, the ratcheting means 218 are set to drive the rotor in the clockwise direction (direction of Arrow "B", FIG. 3) for feeding from the second shell supply 14. Conversely, when the axial pistons 202 and 204 drive the housing 210 end cap 212, pistons 200 and 206 and the shaft extension 208, to a rearwardmost position, the ratcheting means 218 are set to drive the rotor in a counterclockwise direction (Arrow "A") for feeding from the first shell supply 12.

Comprising the ratcheting means 218 is a generally cylindrical first (forward) ratchet element 276 (FIGS. 3 and 4*b*) which is fixed to rearward end regions of a tubular rearward extension 278 of the first rotary piston 200, so that whenever that piston rotates, the first ratchet element also rotates. An identical, second (rearward) ratchet element 280 is fixed to or formed at the rearward end 250 of the shaft extension 208, so that when the shaft extension rotates, the second ratchet element also rotates. Upon assembly of the shaft extension 208 forwardly through the first rotary piston 200 (through the tubular extension 278) the second ratchet element 280 rearwardly abuts the first ratchet element 276.

Cooperating with the ratcheting elements 276 and 280 are two spring loaded first (forward) drive members 282 and two, similar, spring loaded second (rearward) drive members 284. The first drive members 282 are disposed, 90° apart, through forward apertures 286 formed radially inwardly through adjacent vanes 288 and 290 of the rotor 24, at forward ends thereof. In an identical manner, the two second drive members 284 are disposed in more rearward apertures 292 in the same rotor vanes 288 and 290. The pair of first drive members 282 are spaced an axial distance, d, forwardly of the two second drive members 284. (FIGS. 3 and 9).

When installed in the vanes 288 and 290, inner drive ends 294 of the first drive members 282 and inner drive ends 296 of the second drive members 284 project inwardly into a central, axial rotor aperture 298, into which the two ratchet elements 276 and 280 also closely fit.

Figure 9A:
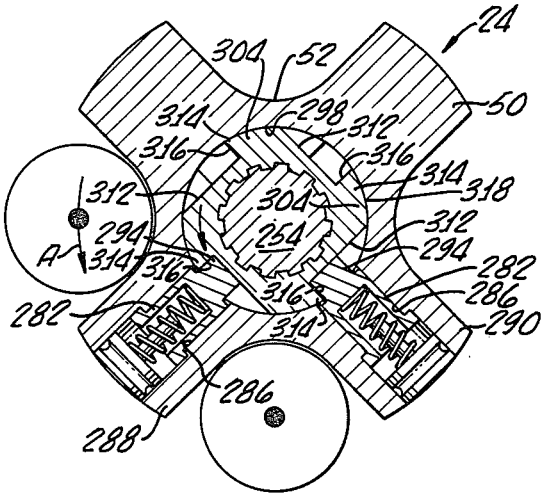
FIG. 9 is a transverse cross sectional view taken along line 9—9 of FIG. 4*a*, FIG. 9*a* showing rotor ratcheting portions of the feeding apparatus set as required for the rotor to feed shells from the first shell supply and FIG. 9*b* showing the ratcheting portion set for feeding from the second supply.
Figure 9B:
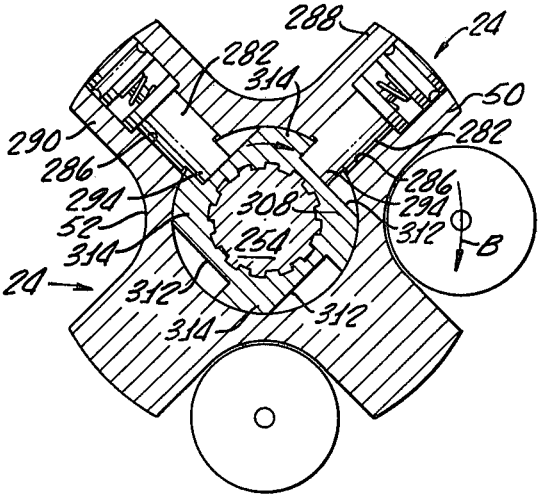

The two ratchet elements 276 and 280 are mounted and configured to drivingly engage, upon assembly, the two pairs of drive member ends 294 and 296, it being apparent, from FIGS. 3 and 9, that whenever these drive ends are drivingly engaged by either or both of the two ratchet elements 276 and 280 and the engaged ratchet element or elements are rotated, the rotor 24 will be correspondingly rotated. However, spring loading of the drive members 282 and 284 also permits the drive ends 294 and 296 to be pushed into the rotor vanes 288 and 290, thereby enabling reverse rotation of the ratchet elements 276 and 280 without rotor rotation, as is also necessary for operation.

To this end, the ratchet elements 276 and 280 are configured so that when the respective shaft extension 208 and first piston 200 are in a forwardmost position (driven forwardly by the axial pistons 202 and 204 with the housing 208), rear halves 304 and 306, respectively of the elements 276 and 280 engage the drive member ends 294 and 296, respectively, in a manner enabling rotary driving, through the members 284, of the rotor 24 in the counterclockwise direction (Arrow "A") by the second piston 206 through the shaft extension 208. In this ratcheting position the shaft extension (and hence, the rotor drive shaft 44) is permitted to ratchet back in the clockwise direction (Arrow "B"). Similarly, the first rotary piston 200 is then also set up to drive the rotor 24 (through the members 282) in the counterclockwise direction, while enabling the rotor to ratchet back in the clockwise direction without piston movement.

The exact opposite occurs when the shaft extension 208 and first piston 200 are driven rearwardly by the axial pistons 202 and 204 so that forward halves 308 and 310, respectively, of the ratchet elements 276 and 280 engage the drive member drive ends 294 and 296, respectively. Accordingly, the two ratchet elements forward halves 308 and 310 are, upon assembly, spaced the same distance, d, apart as are the two pairs of drive members 282 and 284. The same spacing, d, is also provided between the two ratchet element rearward halves 304 and 306. Fore-aft travel distance of the housing 210 and cap 212, the first and second pistons 200 and 206, and the shaft extension 208 is correspondingly required to be equal to the centerline spacing between the forward and rearward ratchet halves 308 and 304 (or 310 and 306), which may be about one half inch.

Each of the ratchet element halves 304, 306, 308 and 310 is formed in short cylindrical shape with partial flats at 90° spacings forming a set of four 90° spaced, offset driving teeth. For example, the first ratchet element rearward half 304, as shown in FIG. 9, includes four partial flats 312 forming four off-center driving teeth 314. Each of these driving teeth 314 has a flat driving face 316 which is perpendicular to the adjacent one of the flats 312. An outer surface region 318 of each of the teeth 314 is arcuate, being on the cylindrical surface of the ratchet element. Thus, the outer surface regions 318 form ramps for driving the forward drive members 282 radially back into their respective apertures 286, thereby enabling reverse ratcheting rotation of the ratchet element and first piston 200 relative to the rotor 24.

The driving teeth 314 on both the ratchet element forward halves 308 and 310 are oriented identically for counterclockwise driving of the rotor 24 for feeding from the first shell supply 12 and for transferring shells into the rotor 24 from the first shell accumulator portion 146 and from the rotor into the second shell accumulator portion 148. In direct contrast, the corresponding driving teeth 314 on the ratchet element rearward ratchet element halves 304 and 306 are faced in the opposite direction to those of the forward element halves for clockwise driving of the rotor 24, for feeding from the second shell supply 14 and for transferring shells into the rotor 24 from the second accumulator portion 148 and from the rotor into the first accumulator portion 146.

Figure 7:
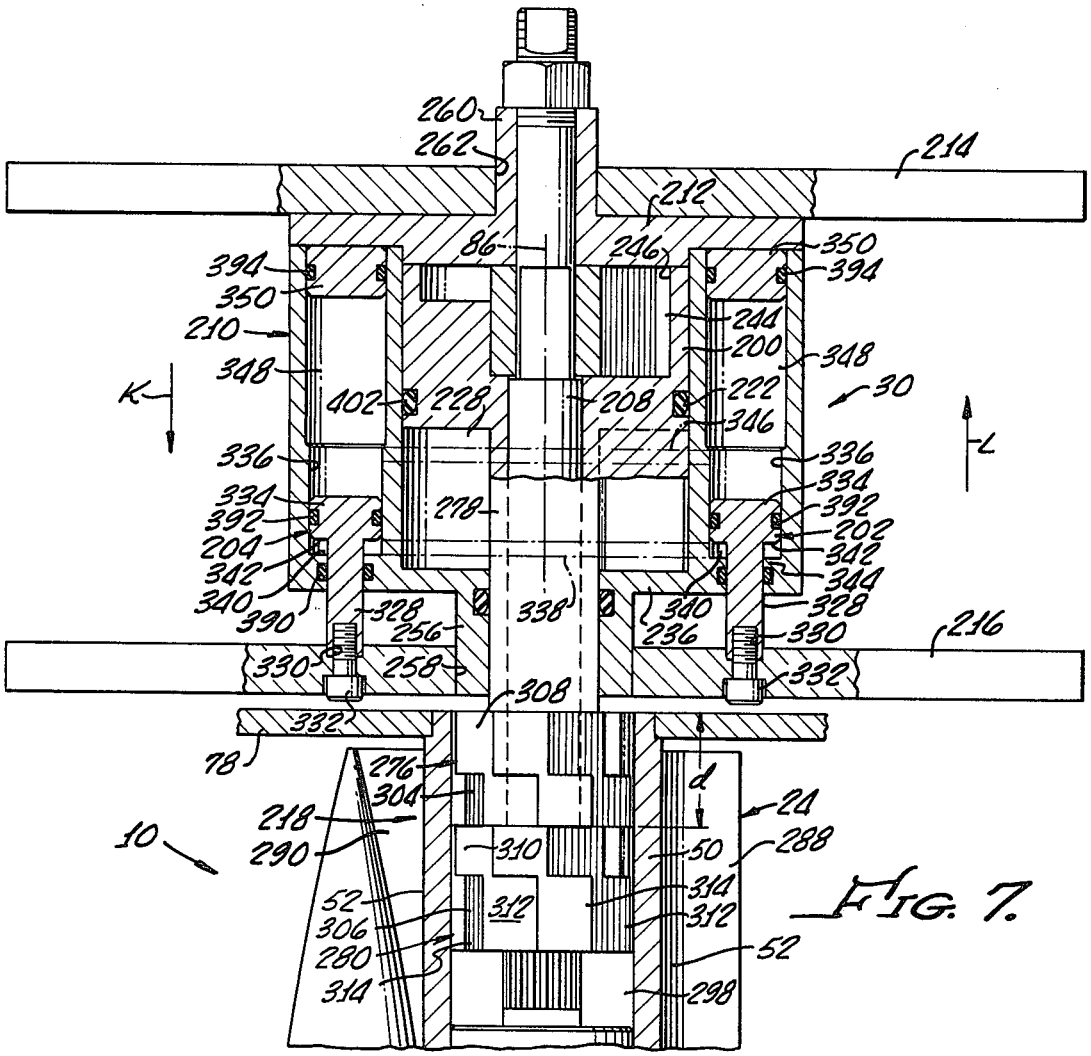
FIG. 7 is a longitudinal sectional view taken along line 7—7 of FIG. 4*a*, showing two longitudinal drive pistons associated with the rotor control means positioned for controlling rotor ratcheting for feeding from the first shell supply.

As above mentioned, fore-aft axial movement of the housing 210 (and therewith the first and second rotary pistons 200 and 206, the end cap 212, shaft extension 208 and the ratchet elements 276 and 280) to set the direction of rotor ratcheting for the next firing sequence, is by the axial pistons 202 and 204. As shown in FIG. 7, each of the pistons 202 and 204 includes an elongate piston shaft 328 a rearward end of which extends through a corresponding aperture 330 in the rear end plate 216 and which is fastened to such plate by a screw 332. A piston head portion 334 of each of the pistons 204 and 206 extends forwardly into a corresponding axial aperture 336 formed rearwardly into the housing 210.

Hydraulic pressure directed to the rear of the piston heads 334, through a first common hydraulic fluid passage 338, in the housing 210, and into a cylindrical chamber 340 defined between a rear face 342 of each piston head and a corresponding annular bottom surface 344 of the aperture 340, causes the housing 210, with the pistons 200 and 206 carried therein, the shaft extension 208 and the ratchet elements 276 and 280 in a rearward direction (direction of Arrow "K"), for enabling the rotor 24 to be driven in the counterclockwise direction (direction of Arrow "A", FIGS. 3 and 5) for feeding shells from the first shell supply 12. A similar second common hydraulic passage 346 is provided forwardly of the piston heads 334 for supplying pressure to a chamber 348 between each piston head and an adjacent plug 350 closing forward regions of the corresponding aperture 336, to thereby drive the housing 210 forwardly (Arrow "L") and set the ratchet elements 276 and 280 for clockwise driving of the rotor 24 (direction of Arrow "B") for feeding shells from the second supply 14.

O-ring seals 390, 392 and 394 are provided to seal the pistons 202 and 204 and the plugs 350 relative to mating regions of the housing 210. As also seen in FIG. 3, an O-ring seal 402 seals the cylindrical portion 226 of the first rotary piston 200 relative to the housing recess 222.

Hydraulic pressure to the hydraulic passageways 338 and 346, from an inlet line 408 (FIGS. 2 and 6) connected between hydraulic pressure source 18 and the housing 210, is controlled by a generally conventional, electrically operated shuttle valve 410 mounted transversely into a housing aperture 412. Operation of the valve 410 is such as to provide hydraulic pressure, from the line 408 either to the first common passageway 338, through an additional housing passageway 414, to drive the housing 212 and corresponding parts, as above described, rearwardly for selecting feeding from the first shell supply 12 or to the second common passageway 346, through an additional housing passageway 416, to drive the housing 210 forwardly for feeding shells from the second shell supply 14.

When hydraulic pressure is supplied from the line 408 through the shuttle valve 410 to the first common passageway 338, through passageway 414, hydraulic fluid is vented from the other common passageway 346, through the passageway 416, through the valve 410 to a hydraulic return line 418 connected to the supply 18. The opposite occurs when the valve 410 is operated to supply hydraulic pressure to the second common passageway 346. Control of the valve 410 is, in turn, by control or switching means 422 connected to the valve by electrical lines 424 (FIGS. 2 and 6).

Simultaneous to supplying hydraulic pressure, through the housing passageways 414 to the first common passageway 338, or to the second common passageway 346, through the housing passageway 416, as controlled by the shuttle valve 410, hydraulic pressure is supplied into the housing chamber 228 to alternate sides of the first rotary piston vane 230.

Thus, as seen from FIG. 6, when the valve 410 is selected to direct hydraulic pressure through the housing passageway 414 to the first common passageway 388 to move the housing 210 rearwardly, for setting the rotor 24 for counterclockwise rotation (Arrow "A", FIG. 3), pressure is also directed through the passageway 414 to a side 430 of the piston vane 230 causing the piston 200 to rotate counterclockwise through 180° to the vane position shown in solid lines in FIG. 6.

In an opposite manner, when hydraulic pressure is directed through the valve 410 to the second common passageway 346, pressure is simultaneously supplied to a second side 432 of the rotary piston vane 230 to cause the first rotary piston 200 to rotate 180° clockwise to the vane position shown in phantom lines in FIG. 6.

Configuration of the axial pistons 202 and 204 relative to the rotary piston 200 is, however, such that the hydraulic pressure acting on the axial pistons shifts the housing 200, piston 200 shaft extension 208 and ratcheting elements 276 and 278 fully fore or aft, according to selection of valve 410 position by the control means 422, before rotary movement of the piston 200 starts. This assures that the ratcheting means 218 is properly set so that the 180° rotary movement of the first piston 200 causes corresponding 180° of rotor rotation for prefiring transfer of shells between the rotor 24 and the shell accumulator means 30, as described above.

As the first rotary piston 200 is hydraulically rotated through 180° in the above described manner for prefiring selection of the rotor drive direction and shell transferring between the rotor 24 and the accumulator means 30, the semi-cylindrical first piston aperture 244 into which the second rotary piston 206 is received is necessarily rotated through the same 180°. As seen in FIG. 8, the second rotary piston 206 has a vane portion 438 that is received into the aperture 244 in a position 45° offset from a barrel gas inlet 440 through the cap 212, such that a pie-shaped gas chamber 442 is formed in the aperture 244 in a region into which the gas inlet 440 discharges.

Figure 8A:
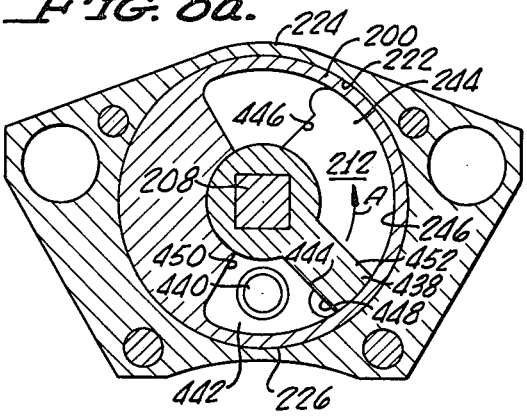
FIG. 8 is a transverse cross sectional view taken along line 8—8 of FIG. 4*a*, FIG. 8*a* showing setting of a second, rotor drive piston, rotatable by barrel gas pressure, to feed shells from the first shell supply and FIG. 8*b* showing setting of the piston for feeding shells from the second shell supply.

As shown in FIG. 8*a*, the first rotary piston 200 is set for enabling the second rotary piston 206 to index the rotor in the counterclockwise direction of Arrow "A" in 90° increments. As such, the second piston vane portion 238 is constrained to rotary movement between first and second aperture inner surface regions 444 and 446. In the prefiring condition shown, a vane side surface 448 abuts the surface region 444 which is adjacent the gas inlet 440. Thus the gas chamber 442 is defined by the vane side surface 448 to one side of the gas inlet 440 and an inner surface 450 defining one end of the semicylindrical aperture 244 on the other side of the gas inlet.

Consequently, when barrel gas is fed into the chamber 442, through the inlet 440, pressure on the vane surface 448 causes the rotary piston 206, and hence the rotor shaft extension 208 and the rotor 24 in counterclockwise direction (Arrow "A") until a second side surface 452 of the vane portion 438 stops against the aperture surface 446. Relative configuration of the second vane portion 438 and angular spacing of the two aperture surfaces 444 and 446 is such as to enable 90° rotation of the second piston 206, and hence of the rotor shaft extension 208 and the rotor 24.

It is important to note that when the first piston 200 is moved axially by the pistons 202 and 204 and is then rotated by the vane 230 through 180°, the second rotary piston 206 is automatically positioned, relative to the first piston aperture 244 and the gas inlet 440 for being rotatably driven by barrel gas, during a subsequent firing sequence, in the proper direction for feeding from the selected shell supply 12 and 14. Since the two ratchet elements 276 and 278 move axially in unison, the former being fixed to the shaft extension 208 and the latter being fixed to the first rotary piston 200, both the first and second rotary pistons are always set for rotor driving in the same direction and relative rotor ratcheting in the opposite direction.

Figure 8B:
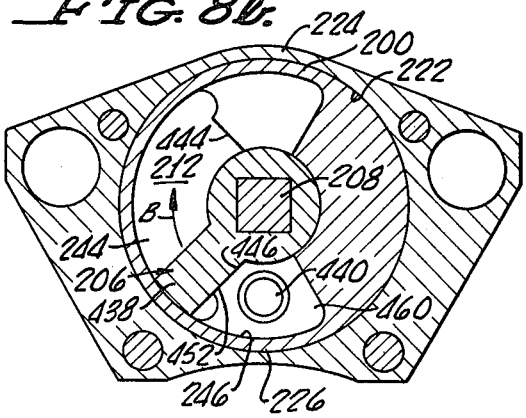

Thus, when the first rotary piston 200 is selectively rotated through 180° in the clockwise direction (direction of Arrow "B") the piston aperture 244 is shifted 180° to the opposite side of the gas inlet 440 (FIG. 8*b*). In the process, the aperture surface 446 engages the vane surface 452 and drives the second piston through only 90° to its prefiring position adjacent to gas inlet 440. In this relative positioning of the first and second rotary pistons 200 and 206 is such that a new gas chamber 460 is formed around the gas inlet, radial ends of such chamber being defined by an aperture end surface 462 and the vane side surface 452. The second vane portion 438 is now set for being driven in the clockwise direction by barrel gases during the next firing sequence.

After each 90° limited rotary driving of the second rotary piston 206 during firing, the torsion spring 46 (FIG. 4) returns such piston to its prefiring condition, the rotor shaft extension 208 being allowed to ratchet back the 90° by the ratchet element 280 while the first ratchet element 276 fixed to the first rotary piston 200 prevents any return rotation of the rotor 24.

This same ratcheting action enables the first rotary piston 200 to be rotated through 180° to change between shell supplies while the second rotary piston is moved thereby only through 90°, ratcheting taking place during the last 90° at first piston rotation.

Barrel gas for operating the second rotary piston 206, for rotatably indexing the rotor in 90° incremental steps during firing, is fed to the gas inlet 440 through barrel gas means, only a line portion 464 of which is shown (FIG. 4). Such line portion 464 axially slidably extends through a mating aperture 466 in the front end plate 214 so that the line moves axially with the housing 210 during axial fore-aft shifting thereof.

OPERATION

Operation of the dual shell feeding apparatus 10 is relatively apparent from the foregoing description. However, a more complete understanding of the invention may be had by briefly reviewing the entire operation. Assume at the start the apparatus 10 is set for feeding shells 20 from first shell supply 12. Accordingly the rotor 24 is set for counterclockwise rotation (direction of Arrow "A", FIG. 5*a*) and the second shell accumulator portion 148 is loaded with two shells 22 which came from the second shell supply 14 via the rotor. The selector 422 has controlled the shuttle valve 410 so that hydraulic pressure is directed the passageway 414 and the common passageway 338 in the housing 210 to the pistons 202 and 204 so as to maintain the housing, as well as the rotary pistons 200 and 206 fully forwardly relative to the end plates 214 and 216 (FIG. 7). In this forward position, the ratchet portions 304 and 306 are positioned, relative to the ratchet elements 282 and 284 for counterclockwise rotor driving. Since the first piston 200 is rotated fully, counterclockwise (FIG. 6, solid lines) and held in that position by hydraulic pressure, the corresponding ratchet portion 308, does not rotate during firing of the gun 16 and therefore locks the rotor 24 against any clockwise rotation (FIG. 3). Counterclockwise rotation of the shaft extension 208 by the second piston during firing of the gun drives the rotor 24, through the ratchet portions 310 and the ratchet elements 282 counterclockwise; however, those ratchet elements, by depressing outwardly, in the vanes 288 and 290 permit return, clockwise rotation of the shaft extension 208 and the attached ratchet member 280. Thus reciprocating rotary movement of the shaft extension 208, and hence also the rotor shaft 44 is converted into unidirectional, 90° incremental stepping of the rotor 24 in the counterclockwise direction, as is required for feeding shells 20 from the first supply 12.

When firing from the first shell supply 12 stops, the control means 34 remains set, unless set otherwise, for still firing from the first shell supply 12 during the next firing sequence. As above mentioned, the firing is, however, stopped with two shells form the first supply 12 in the rotor. This may be enabled, for example, when using a shell by magazine having different rows of shells rotatable into the feeding position (FIG. 2), first and second shell sensing switches 480 and 482 which sense pressure of shells in the shell pick up position 28 and in a next to the last shell position in any row set up for firing. During firing, as soon as both switches 480 and 482 sense no shells at their respective position a searing up signal is generated. This occurs when a shell has just been stripped from the pickup position 28 by the bolt 98 with one shell remaining in the rotor 24 and another shell is awaiting immediate transfer into the rotor. When feeding belted ammunition it will be appreciated that firing can generally be stopped without such sear control as described, as there will always, except at the end of the belt, be shells left to be fed into the rotor 24; it is just with row type feeding where such special control is necessary to prevent firing the last shell in a row and emptying the rotor before a next row is moved into the feeding position.

Assuming firing has stopped and a switchover to firing of shells 22 from the second shell supply is desired or necessary. The selector 422 resets the shuttle valve 410 so that hydraulic pressure is routed through housing passageways 416 and 346 to the pistons 202 and 204 so as to drive housing 210 with the first and second rotary pistons 200 and 206, the shaft extension 208 and the ratchet members 276 and 280 rearwardly relative to the end plates 214 and 216 (direction of Arrow "K", FIG. 6). This sets up the ratcheting means 218 for clockwise rotor rotation (direction of Arrow "B", FIGS. 3 and 5).

Immediately thereafter, hydraulic pressure action on the first piston vane 230 rotates the first piston 200, and through the ratchet member 276 and elements 282, the rotor 24 180° clockwise. This 180° clockwise rotor rotation transfers the two shells 174 and 178 from the first shell supply 12 just left in the rotor 24 up into the corresponding accumulator portion 146. It the same time, the two shells 176 and 180 from the second shell supply 14, are transferred from the second accumulator portion 148 back down into the rotor 24 in readiness for the next firing (FIG. 5(*c*)). At the same time, the second rotary piston 206 is set up (FIG. 8(*b*)) for causing clockwise rotor rotation during the next firing sequence.

Subsequent switching back to feeding from the first shell supply 12, reloads the shells 174 and 178 from the first shell accumulator 146 back into the rotor 24 and transfers the two shells from the rotor up into the second accumulator portion 148 and sets the second rotary piston 206 and ratcheting means 218 for counterclockwise shell feeding rotation during the next firing sequence.

In the preferred embodiment only 90° rotor rotation of a single shell is required for shell transferring with each single firing of the gun 16. Therefore, the feeding operation can be very rapid and stress loading on the feeder parts is minimized. However two shells from the other supply are always waiting in readiness for automatic reloading into the rotor 24 whenever a shift to feeding from the other supply is made. Shifting between feeding from the two supplies 12 and 14 is thus also very rapid, as is desirable for combat situations.

Although there has been described above a specific arrangement of dual shell feeding apparatus with shell accumulator in accordance with the invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

I claim:

1. Dual shell feeding apparatus for an automatic gun or the like having a shell pick up position to which shells are fed for subsequent picking up and loading into a gun firing chamber for firing, and having associated first and second shell supplies located relatively adjacent the shell pick up position, the dual shell feeding apparatus comprising:

(a) feeding means mounted intermediate the first and second shell supplies and said shell pick up position, and configured for transporting, during firing of the gun, shells from either selected one of the first and second shell supplies to said shell pick up position;

(b) selecting means for prefiring selection of from which one of said first and second shell supplies said feeding means will feed shells to the shell pick up position during a next gun firing sequence;

(c) means for stopping firing of the gun with a shell from the shell supply feeding the gun left in said feeding means at said pick up position; and, (d) shell accumulator means separate from said first and second shell supplies for removing, whenever feeding of the gun is selectively changed by the selecting means from one shell supply to the other, from the feeding means said shell left therein and for storing said shell until the next time the selecting means reselects the shell supply corresponding to said stored shell and for thereupon transferring said stored shell back into said feeding means at said pick up position for feeding thereby to the gun.

2. The dual shell feeding apparatus according to claim 1, wherein the feeding means includes a rotor having means defining a plurality of shell transporting cavities around the periphery thereof and means rotatably mounting the rotor relative to the first and second shell supplies and the shell pick up position so that when any one of the rotor cavities is in shell feeding relationship with the shell pick up position another one of the rotor cavities is in shell receiving relationship with the first shell supply and still another one of the rotor cavities is in shell receiving relationship with the second shell supply.

3. Dual shell feeding apparatus for an automatic gun or the like having a shell pick up position to which shells are fed for subsequent picking up and loading into a gun firing chamber for firing, and having associated first and second shell supplies located relatively adjacent the shell pick up position, the dual shell feeding apparatus comprising:

(a) feeding means mounted intermediate the first and second shell supplies and said shell pick up position, and configured for transporting, during firing of the gun, shells from either selected one of the first and second shell supplies to said shell pick up position;

said feeding means including a rotor having means defining a plurality of shell transporting cavities around the periphery thereof and means rotatably mounting the rotor relative to the first and second shell supplies and the shell pick up position so that when any one of the rotor cavities is in shell feeding relationship with the shell pick up position another one of the rotor cavities is in shell receiving relationship with the first shell supply and still another one of the rotor cavities is in shell receiving relationship with the second shell supply, said feeding means further including means during firing of the gun, for rotatably stepping the rotor in a first rotatioal direction for feeding shells from the first shell supply to the shell pick up position and in a second, opposite rotational direction for feeding shells from the second shell supply to the shell pick up position, said feeding means further including means for transferring shells from only the first shell supply into indexed rotor cavities when the rotor is stepped, during firing, in the first direction and only from the second shell supply when the rotor is stepped, during firing, in the second direction, (b) selecting means for prefiring seletion of from which one of said first and second shell supplies said feeding means will feed shells to the shell pick up position during a next gun firing sequence;

(c) means for stopping firing of the gun with at least one shell from the shell supply feeding the gun left in said feeding means; and, (d) shell accumulator means for removing, whenever feeding of the gun is selectively changed by the selecting means from one shell supply to the other, from the feeding means said at least one shell left therein and for storing said at least one shell until the next time the selecting means reselects the shell supply corresponding to said at least one stored shell and thereupon transferring said at least one stored shell back into said feeding means for feeding thereby to the gun.

4. Dual shell feeding apparatus for an automatic gun or the like having a shell pick up position to which shells are fed for subsequent picking up and loading into a gun firing chamber for firing, and having associated first and second shell supplies located relatively adjacent the shell pick up position, the dual shell feeding apparatus comprising:

(a) feeding means mounted intemediate the first and second shell supplies and said shell pick up position, and configured for transporting, during firing of the gun, shells from either selected one of the first and second shell supplies to said shell pick up position;

said feeding means including a rotor having means defining a plurality of shell transporting cavities around the periphery thereof and means rotatably mounting the rotor relative to the first and second shell supplies and the shell pick up position so that when any one of the rotor cavities is in shell feeding relationship with the shell pick up position another one of the rotor cavities is in shell receiving relationship with the first shell supply and still another one of the rotor cavities is in shell receiving relationship with the second shell supply, said feeding means further including means, during firing of the gun, for rotatably stepping the rotor in a first rotational direction for feeding shells from the first shell supply to the shell pick up position and in a second, opposite rotational direction for feeding shells from the second shell supply to the shell pick up position, said feeding means further including means for transferring shells from only the first shell supply into indexed rotor cavities when the rotor is stepped, during firing, in the first direction and only from the second shell supply when the rotor is stepped, during firing, in the second direction, (b) selecting means for prefiring selection of from which one of said first and second shell supplies said feeding means will feed shells to the shell pick up position during a next gun firing sequence;

said selecting means being configured for enabling setting of the direction of shell transferring rotor rotation during a next firing sequence, the shell supply corresponding to the selected direction of shell transferring rotor rotation being thereby selected for feeding the gun during said next firing sequence;

(c) means for stopping firing of the gun with at least one shell from the shell supply feeding the gun left in said feeding means; and, (d) shell accumulator means for removing, whenever feeding of the gun is selectively changed by the selecting means from one shell supply to the other, from the feeding means said at least one shell left therein and for storing said at least one shell until the next time the selecting means reselects the shell supply corresponding to said at least one stored shell and thereupon transferring said at least one stored shell back into said feeding means for feeding thereby to the gun.

5. The dual shell feeding apparatus according to claim 1, wherein said shell accumulator means are responsive to said selecting means, prefiring selection by the selecting means of a different one of the shell supplies for a next firing sequence causing transfer of shells between the accumulator means and the feeding means.

6. Dual shell feeding apparatus for an automatic gun or the like having means defining a shell pick up position to which shells are fed for subsequent picking up and loading into a gun firing chamber for firing, and having associated first and second shell supplies mounted relatively adjacent the shell pick up position, the dual shell feeding apparatus comprising:

(a) a rotor having a plurality of peripheral shell holding cavities and means rotatably mounting the rotor in shell transferring relationship between the first and second shell supplies and the shell pick up position;

(b) selecting means for selecting from which one of the shell supplies the gun is to be fed shells during a next firing sequence;

(c) feeding means, during firing of the gun, for rotatably stepping the rotor to feed shells from the selected shell supply to the shell pick up position, said means including means during firing of the gun for transferring only shells from the selected shell supply into the rotor cavities for subsequent rotary transfer thereby to said pick up position;

(d) means for stopping firing of the gun with at least one of the shells from said selected supply left in the rotor cavities; and, (e) shell accumulating means, responsive to prefiring changing by the selecting means of the shell supply from which the gun is to be fed during a next firing sequence, for removing from the rotor cavities said at least one shell left therein and for storing said at least one shell until the next time the corresponding shell supply is selected for feeding from and, in response thereto, for transferring said at least one shell back into the rotor cavities for subsequent rotary transferring to the shell pick up position.

7. The dual shell feeding apparatus according to claim 6, wherein said feeding means are configured for causing the rotor to be rotatably stepped, during firing of the gun, in a first rotational direction to feed shells from the first shell supply to the pick up position and in a second, opposite rotational direction to feed shells from the second shell supply, and wherein the selecting means are operative for presetting the direction of rotor rotation during the next firing sequence according to whichever one of the shell supplies is to feed the gun during said next firing sequence.

8. The dual shell feeding apparatus according to claim 6, wherein the accumulator means include first and second shell accumulator portions for receiving and storing shells, respectively from said first and second shell supplies.

9. Dual shell feeding pparatus for an automatic gun or the like having a shell pick up position to which shells are fed for subsequent picking up and loading into a gun firing chamber for firing, and having associated first and second shell supplies located relatively adjacent the shell pick up position, the dual shell feeding apparatus comprising:

(a) a shell transferring rotor having a plurality of peripheral shell transporting cavities, and means rotatably mounting said rotor in shell transferring relationship between the first and second shell supplies and said shell pick up position;

(b) means, during firing of the gun, for rotatably stepping the rotor in a first rotational direction to feed shells from the first shell supply to the pick up position and for rotatably stepping the rotor in a second rotational direction to feed shells from the second shell supply to the pick up position, said means including means for transferring shells only from the first shell supply into the rotor cavities when the rotor is rotated in the first direction and only from the second shell supply when the rotor is rotated in the second direction;

(c) control means for prefiring, selective setting of the direction of rotor rotation during a next firing sequence of the gun, thereby enabling selection of from which shell supply the gun is to be fed during said next firing sequence;

(d) means for stopping firing of the gun with at least one of the shells from the supply feeding the gun left in the rotor; and, (e) shell accumulator means responsive to said control means whenever the control means selectively sets a different rotor rotational direction for a next firing sequence of the gun for prefiring receiving from the rotor any shells remaining in the cavities thereof when the previous firing stopped and for prefiring feeding into the rotor cavities any shells already held in the accumulator means.

10. The dual shell feeding apparatus according to claim 9, wherein the shell accumulator means include separate first and second shell accumulator portions each positioned in shell communicating relationship with the rotor cavities, and are configured so that when the control means set the rotor to rotate in the first instead of a just previously set second rotational direction so as to feed shells from the first shell supply, all shells from the second shell supply remaining in the rotor cavities are transferred into the second accumulator portion and all shells held in the first accumulator portion are transferred into the rotor cavities, and so that when the control means set rotor to rotate in the second instead of a just previously set first direction so as to feed shells from the second shell supply, all shells from the first shell supply remaining in the rotor cavities are transferred into the first accumulator portion and shells held in the second accumulator portion are transferred into the rotor cavities.

11. The dual shell supply apparatus according to claim 9, wherein the rotor is configured and mounted so that any one of the rotor cavities is indexed into shell feeding relationship with said shell pick up position, another one of the rotor cavities is indexed into shell transferring relationship with said first shell supply and still another one of the rotor cavities is indexed into shell transferring relationship with said second shell supply.

12. Dual shell feeding apparatus for an automatic gun or the like having a shell pick up position to which shells are fed for subsequent picking up and loading into a gun firing chamber for firing, and having associated first and second shell supplies located relatively adjacent the shell pick up position, the dual shell feeding apparatus comprising:

(a) a shell transferring rotor having means defining a plurality of circumferentially spaced apart shell holding cavities around a periphery thereof, and means mounting the rotor relative to the shell supplies and the shell pick up position so that when any one of the rotor cavities is indexed into shell feeding relationship with the pick up position, another one of the rotor cavities is indexed into shell receiving relationship with the first shell supply and still another one of the rotor cavities is indexed into shell receiving relationship with said second shell supply;

(b) means, during firing of the gun, for rotatably stepping the rotor in a first rotational direction for feeding shells from the first shell supply to the shell pick up position and for rotatably stepping the rotor in a second rotational direction for feeding shells from the second shell supply to the shell pick up position, said means including feed means for feeding, during firing of the gun, only shells from the first shell supply into indexed rotor cavities when the rotor is stepped in said first rotational direction and for feeding shells only from the second shell supply into indexed rotor cavities when the rotor is stepped in said second rotational direction;

(c) selecting means for prefiring, selective setting of the direction of rotor rotation during a next firing sequence of the gun and for thereby selecting from which of the shell supplies the gun will be fed during said next firing sequence;

(d) means for stopping firing of the gun with a plurality of shells from the supply first feeding the gun left in the rotor cavities;

(e) accumulator means for storing a plurality of shells, said accumulator means being mounted in shell transferring relationship with said rotor cavities; and, (f) means responsive to said control means for causing, whenever the control means sets the rotor for a different rotational feeding direction during a next firing sequence, said plurality of shells left in the rotor from the previous firing sequence to be transferred from the rotor into said accumulator means, and simultaneously for causing any shells already in the accumulator to be transferred into the rotor for said next firing sequence.

13. The dual shell accumulator according to claims 3, 7, 9 or 12, wherein said selecting means is configured for selecting the direction of rotor rotational stepping for a next firing sequence by rotating the rotor through an arc which is about twice as great as that the rotor is stepped through for each shell feeding.

14. The dual shell feeding apparatus according to claim 13, wherein the rotor is formed having four shell holding cavities at 90 degree rotational intervals, and wherein the feeding means are operative for rotatably stepping the rotor 90 degrees for feeding each shell from the selected shell supply to the shell pick up position.

15. The dual shell feeding apparatus according to claim 13, wherein said selecting means include a hydraulically actuated rotary piston for rotating the rotor through said arc.

16. The dual shell feeding apparatus according to claim 3, 7, 9 or 12, wherein the means for rotatably stepping the rotor during firing of the gun include rotary piston ratcheting means interconnecting said piston to the rotor for enabling the rotor to rotate continuously in the selected feeding direction during firing while enabling the rotary piston to be rotatably driven in said selected feeding direction and then return rotate to an initial position with each shell fired, and further including means for causing said return rotation of the rotary